US008651096B2

(12) United States Patent
Sikes

(10) Patent No.: US 8,651,096 B2
(45) **Date of Patent: *Feb. 18, 2014**

(54) SYSTEMS, DEVICES, AND/OR METHODS FOR LAUNCHING A PROJECTILE

(71) Applicant: Lloyd Stephen Sikes, Charlottesville, VA (US)

(72) Inventor: Lloyd Stephen Sikes, Charlottesville, VA (US)

(73) Assignee: Long Range, LLC, Charlottesville, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/688,372

(22) Filed: Nov. 29, 2012

(65) Prior Publication Data

US 2013/0104868 A1 May 2, 2013

Related U.S. Application Data

(63) Continuation of application No. 12/854,227, filed on Aug. 11, 2010, now Pat. No. 8,322,329.

(60) Provisional application No. 61/335,349, filed on Jan. 6, 2010.

(51) Int. Cl.
*F41B 11/32* (2006.01)

(52) U.S. Cl.
USPC ..... 124/73

(58) Field of Classification Search
USPC ..... 124/64, 69, 70, 71, 73, 74–77
See application file for complete search history.

(56) References Cited

U.S. PATENT DOCUMENTS

| | | | | |
|---|---|---|---|---|
| 5,450,839 | A * | 9/1995 | Nicolaevich et al. | 124/73 |
| 5,755,055 | A | 5/1998 | Thompson | |
| 5,761,840 | A | 6/1998 | Martin | |
| 6,810,871 | B2 * | 11/2004 | Jones | 124/77 |
| 6,941,938 | B2 | 9/2005 | D'Arcy | |
| 7,757,682 | B2 | 7/2010 | Kaminker | |
| 7,849,845 | B2 | 12/2010 | Page | |
| 8,020,331 | B2 | 9/2011 | Martin | |
| 8,322,329 | B1 * | 12/2012 | Sikes | 124/73 |
| 2004/0107951 | A1 | 6/2004 | D'Arcy | |
| 2008/0168974 | A1 | 7/2008 | Kaminker | |
| 2010/0223830 | A1 | 9/2010 | Martin | |
| 2010/0282324 | A1 | 11/2010 | Page | |
| 2011/0017188 | A1 | 1/2011 | Call | |

FOREIGN PATENT DOCUMENTS

| | | |
|---|---|---|
| WO | WO2004/053419 | 6/2004 |
| WO | WO2009/088557 | 7/2009 |

* cited by examiner

*Primary Examiner* — Michael Carone
*Assistant Examiner* — Reginald Tillman, Jr.
(74) *Attorney, Agent, or Firm* — Michael Haynes PLC; Michael N. Haynes

(57) ABSTRACT

Certain exemplary embodiments can provide a system, machine, device, manufacture, circuit, composition of matter, and/or user interface adapted for and/or resulting from, and/or a method and/or machine-readable medium storing machine-implementable instructions for, activities that can comprise and/or relate to, controlling the amount of energy delivered to a projectile from a source of compressed gas.

21 Claims, 15 Drawing Sheets

SYSTEMS, DEVICES, AND/OR METHODS FOR LAUNCHING A PROJECTILE

CROSS-REFERENCES TO RELATED APPLICATIONS

This application claims the priority to U.S. Provisional Patent Application 61/335,349, filed 6 Jan. 2010.

BRIEF DESCRIPTION OF THE DRAWINGS

A wide variety of potential practical and useful embodiments will be more readily understood through the following detailed description of certain exemplary embodiments, with reference to the accompanying exemplary drawings in which.

DETAILED DESCRIPTION

Figure 1:
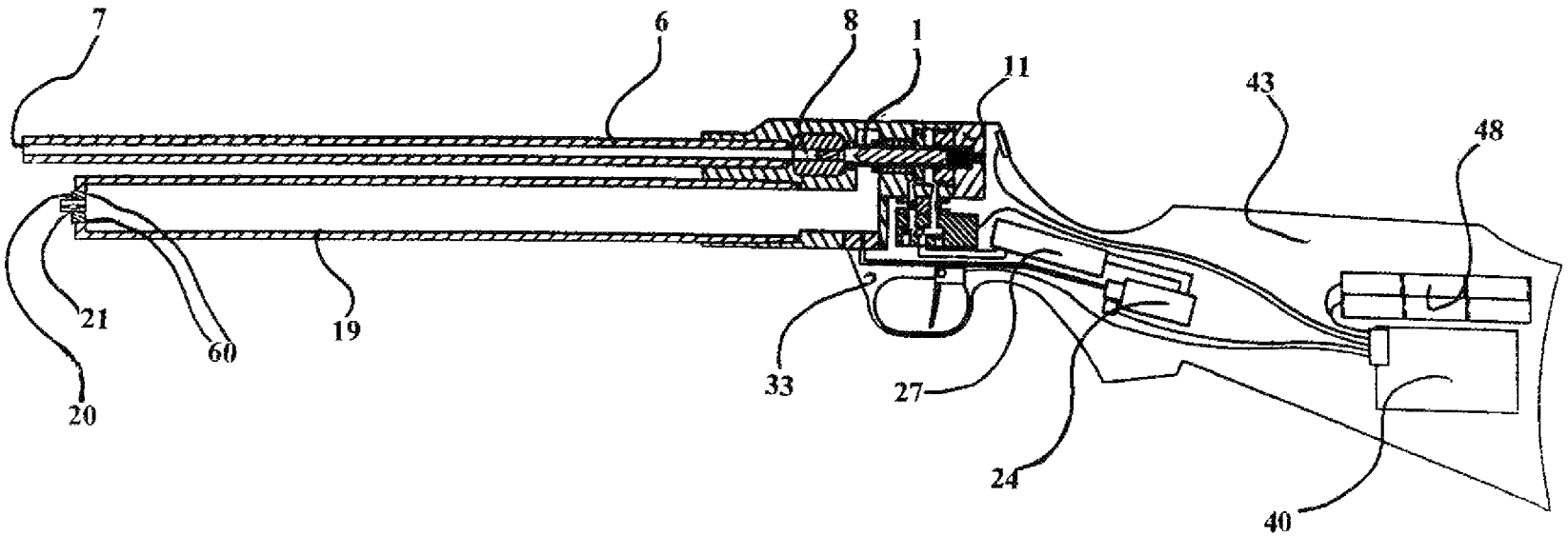
FIG. 1 is a side view of an exemplary air gun.

Certain exemplary embodiments relate to guns and/or to guns employing an expansion of a compressed gas to selectively launch a projectile, and/or to a firing valve that is controlled by passage of a regulated gas pressure from a solenoid valve to selectively expose a breech to a source of high pressure gas.

Pre-charged pneumatic guns can use high pressure tanks having initial operating pressures in excess of approximately 500 psi to in excess of approximately 5,000 psi, including all values and sub-ranges therebetween. Because the pressure in the high pressure tank can diminish with each successive firing, the volume of released gas, and/or the energy released from the high pressure tank with each firing, can begin to vary such that the velocity of the exiting projectile can vary. This change in the exit velocity can be particularly evident as the pressure in the high pressure tank reaches a lowest useable level.

In certain exemplary systems, a manually operated bolt can be used to open the breech for the loading of a projectile, and/or to cock the spring powered hammer assembly used in the firing of the projectile. The trigger assembly can trip a sear that can retain the spring that in turn can release a hammer for firing; and in turn, can drive open a valve that can release a quantity of high pressure gas to propel the projectile. The valve, when knocked open, can provide passage of high pressure gas for firing, and then can be forced shut at approximately the right moment for firing. Since these actions can be mechanical and only approximate in timing and forces, the pressure of the high pressure gas can diminish with each firing, and as the energy begins to degrade, the exiting projectile velocity can degrade.

In certain exemplary embodiments, the mechanical 'knock open' valve is not necessarily able to fully exploit the energy stored in the high pressure tank at lower pressure levels. In these systems, a point can be reached wherein there is ample energy in the high pressure tank for several more shots of useable velocity, but the mechanical valve is unable to maintain an open state long enough to transfer the available energy to the projectile. Therefore, the shooting of the gun can be interrupted and the pre-charged pneumatic tank can be refilled to full pressure, thereby leaving unused available energy in the tank.

There can be a benefit from providing a gun having a valving mechanism that can control the amount of energy delivered to a projectile from a source of compressed gas.

Certain exemplary embodiments can provide a predictable and/or repeatable projectile exit speed and/or exit energy to a projectile powered by the selective release of a high pressure gas.

Certain exemplary embodiments can provide a sliding valve, that, in certain configurations, can be a "tubular" valve that can expose a reduced frontal area (with respect to a solid cylindrical valve) to the high pressure gas entering into the breech, which can facilitate rapid closing to optimally fire the projectile. That is, the face of the tubular valve (viewed along the valve's longitudinal axis) can be substantially annular rather than a solid circle, meaning that the valve can have, with respect to the solid circular face of a solid cylindrical valve, a substantially reduced, substantially annularly-shaped, facial and/or frontal area upon which the pressure of the high pressure gas can impose. Such a reduced area can proportionally reduce the force generated by that pressure along the valve's longitudinal axis and/or a force needed to overcome the pressure-generated force to close the valve.

Figure 10:
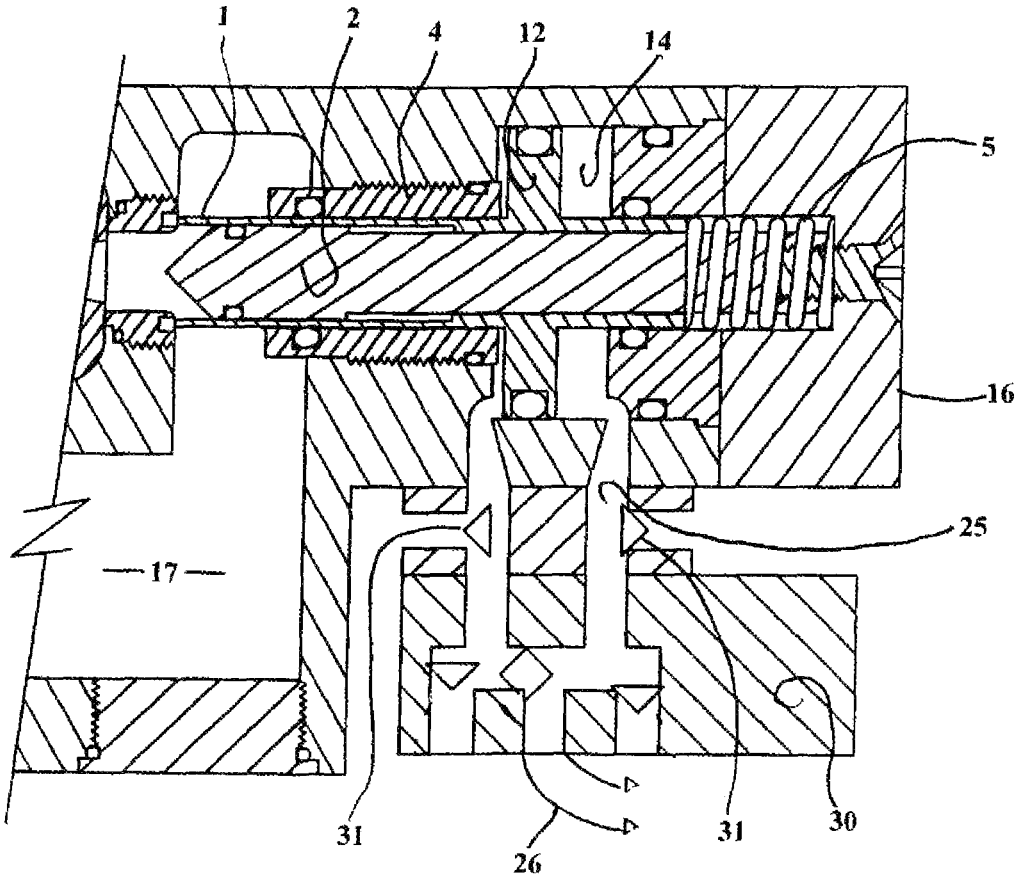
FIG. 10 is a cross sectional view of the exemplary air gun of FIG. 8.
Figure 11:
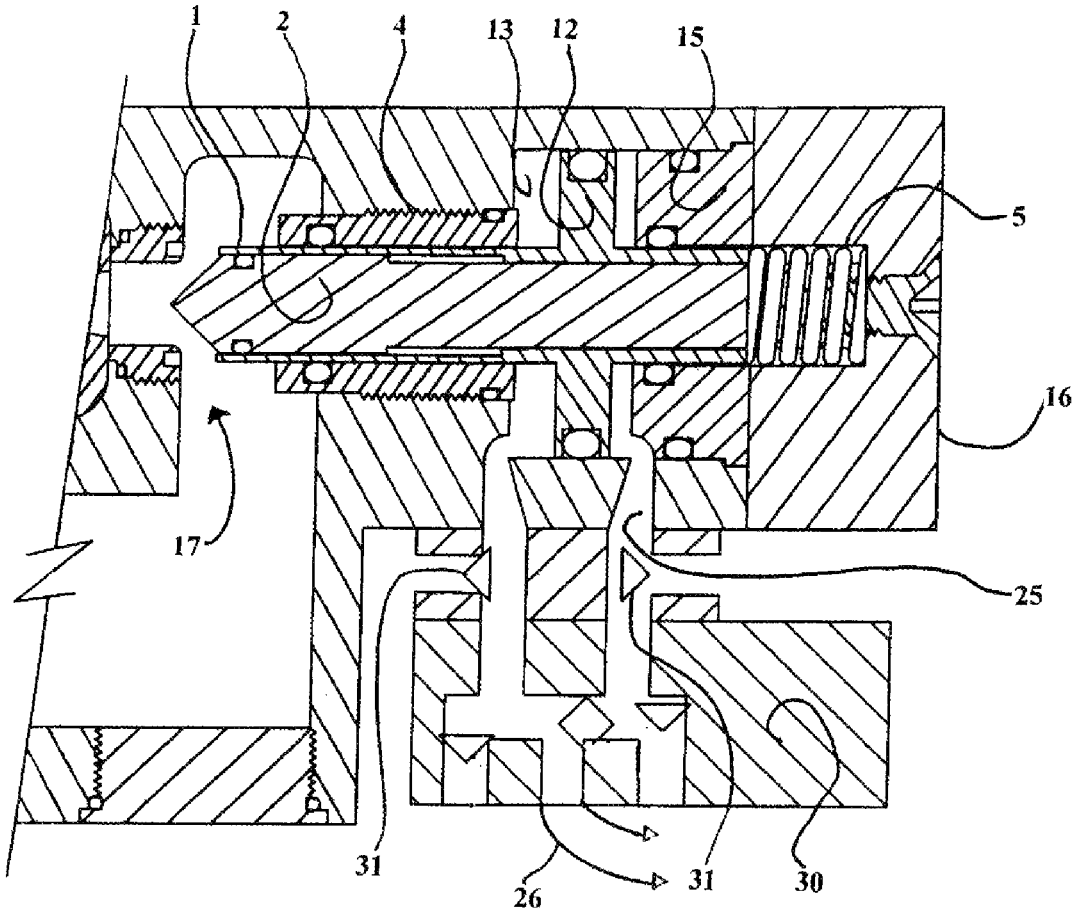
FIG. 11 is a cross sectional view of the air gun of FIG. 8.

The tubular valve can circumferentially surround a solid and/or fixed core such that the tubular valve can slide over and/or along the fixed core, which can remain substantially stationary with respect to the gun body, and/or, in at least certain valve positions, such as an open position, can substantially fill an interior cavity portion defined by the tubular valve. As shown in FIGS. 10 and 11, the face of the fixed core can be conical, or any other shape that can help direct the high pressure gas to the back of the projectile and/or help reduce turbulence and/or friction losses associated with the flow of the high pressure gas. Via a slideable, yet substantially pneumatically sealed, arrangement between the tubular valve and the fixed core and/or between the tubular valve and a cylinder within which the tubular valve is adapted to slide, the high pressure gas can be substantially prevented from flowing through the fixed core or the interior cavity portion of the tubular valve. Based on this arrangement, the sliding valve can be adapted to, in the closed position and within approximately 2 milliseconds, substantially halt flow of the high pressure gas when the high pressure gas has a static pressure of approximately 3500 psi or more, and/or, in the open firing position and within approximately 10 milliseconds, pneumatically deliver up to approximately 2,500 foot pounds of energy to the projectile.

Via a double-acting piston connected to the sliding valve and/or adapted to move between an open position and a closed position, the opening and/or closing of the sliding valve can be controlled by selective exposure to a controlled and/or regulated gas pressure thereby providing a valve timing that can allow for increased control over the amount of energy delivered in a given firing cycle.

Certain exemplary embodiments can employ a solenoid valve, such as a single four way solenoid valve or a pair of three way solenoid valves, for controlling the passage of a regulated pressure gas, which in turn, can control passage of the high pressure gas to the projectile and/or can provide a consistent energy to each projectile by controlling the amount of high pressure gas used to launch each projectile corresponding to a varying pressure within the high pressure gas source.

In certain exemplary embodiments, high pressure gas (a motive gas) from a high pressure gas tank can be regulated to a low pressure gas (a control gas), which can be controlled and/or directed by a solenoid valve to act on the double acting piston and hence the sliding valve, which can vary and/or separately control the passage of high pressure gas to the projectile. This control of the passage of the high pressure gas can provide a consistent energy to the projectile substantially independent of variations in the pressure of the motive gas. The solenoid valve can be electronically, rather than mechanically, controlled and/or operated, and/or can provide a greater degree of control than mechanically controlled valves. The solenoid valve can be employed to employ a low pressure gas that can perform as a spring to operate the projectile launch quickly and/or consistently, yet immediately can provide the readiness for the next firing.

The low pressure (regulated) control gas for actuating the double acting piston can be derived from the high pressure motive gas through a regulator, which can convert a portion of the high pressure gas from the high pressure tank into low pressure gas, which can be passed to the low pressure reservoir and/or directly to the solenoid valve. The solenoid valve selectively can pass the low pressure gas to one of a front and a rear chamber of the double acting piston, thereby urging the piston in the respective direction. To relieve backpressure during operation, a quick action exhaust valve can be operably located in each air circuit between the solenoid valve and the respective chamber of the double acting chamber, thereby allowing the introduced low pressure gas from the solenoid to move the piston more quickly than if the low pressure gas were exhausted through the passages of the solenoid valve.

The double acting piston (and hence sliding valve) can be actuated to slide open and/or to slide closed in response to the low pressure gas provided by the solenoid valve (via the regulator), which in turn can be timed by an electronic control module. The electronic control module thereby can provide for admitting and/or exhausting low pressure gas from the front chamber and/or the rear chamber of the double acting piston, as the solenoid valve selectively exposes the low pressure gas to the front chamber and/or the rear chamber of the double acting piston to slide open and/or to slide closed.

Certain exemplary embodiments can provide a controller that is programmed to calculate, determine, generate, and/or transmit, upon receiving a user-initiated trigger event, a request and/or command to the solenoid valve(s) to stay open for one or more predetermined periods of time, which will cause the solenoid valve to provide a timed burst of gas that will activate the double-acting piston and thereby the sliding valve to open and close, thereby firing a projectile. Each request of a group of requests can be based on the available high pressure gas pressure, the weight of each projectile in the corresponding group of projectiles, a user-selected kinetic energy for the fired projectiles, and/or a user-selected velocity for the fired projectiles. Regardless of the weight of each of the group of projectiles, the kinetic energy and/or velocity of each projectile can have a positive non-zero value (such as described herein), and/or can remain substantially constant for all of the group of projectiles even though the pressure of the high pressure gas diminishes with each firing of the gun. That is, by monitoring the available gas pressure and/or projectile weight, the controller can adjust the timing of each request and/or gas burst to hold the projectile kinetic energy and/or the projectile velocity (whether measured at the breech, muzzle, and/or shortly after exiting the barrel) substantially constant and/or substantially consistent with the user-selected value.

For example, a .22 caliber gun with an approximately 28 inch long barrel, using approximately 800 psi, could propel an approximately 13 grain projectile from as slow as approximately 300 fps (approximately 3 foot pounds) to as fast as approximately 1600 fps (approximately 74 foot pounds) if using 3500 psi. As another example, a .22 caliber gun with an approximately 28 inch long barrel, using approximately 800 psi, could propel an approximately 35 grain projectile from as slow as approximately 300 fps (approximately 7 foot pounds) to as fast as approximately 1600 fps (approximately 199 foot pounds) if using 3500 psi. As still another example, a .700 caliber gun with an approximately 32 inch long barrel, using approximately 800 psi, could propel an approximately 520 grain projectile from as slow as approximately 300 fps (approximately 104 foot pounds) to as fast as approximately 1200 fps (approximately 1663 foot pounds) if using 3500 psi. As yet another example, a .700 caliber gun with an approximately 32 inch long barrel, using approximately 800 psi, could propel an approximately 1200 grain projectile from as slow as approximately 300 fps (approximately 240 foot pounds) to as fast as approximately 950 fps (approximately 2405 foot pounds) if using 3500 psi.

In certain exemplary embodiments, the electronics can make the gun fire a projectile at a specific user-selected velocity and/or energy level. This can be accomplished by energizing the coil(s) in the solenoid(s) for a relatively precise amount of time so that the low pressure piston opens the tube valve for the correct amount of time for the HPA to force the projectile out of the gun barrel at the user-selected velocity and/or energy level.

Figure 14:
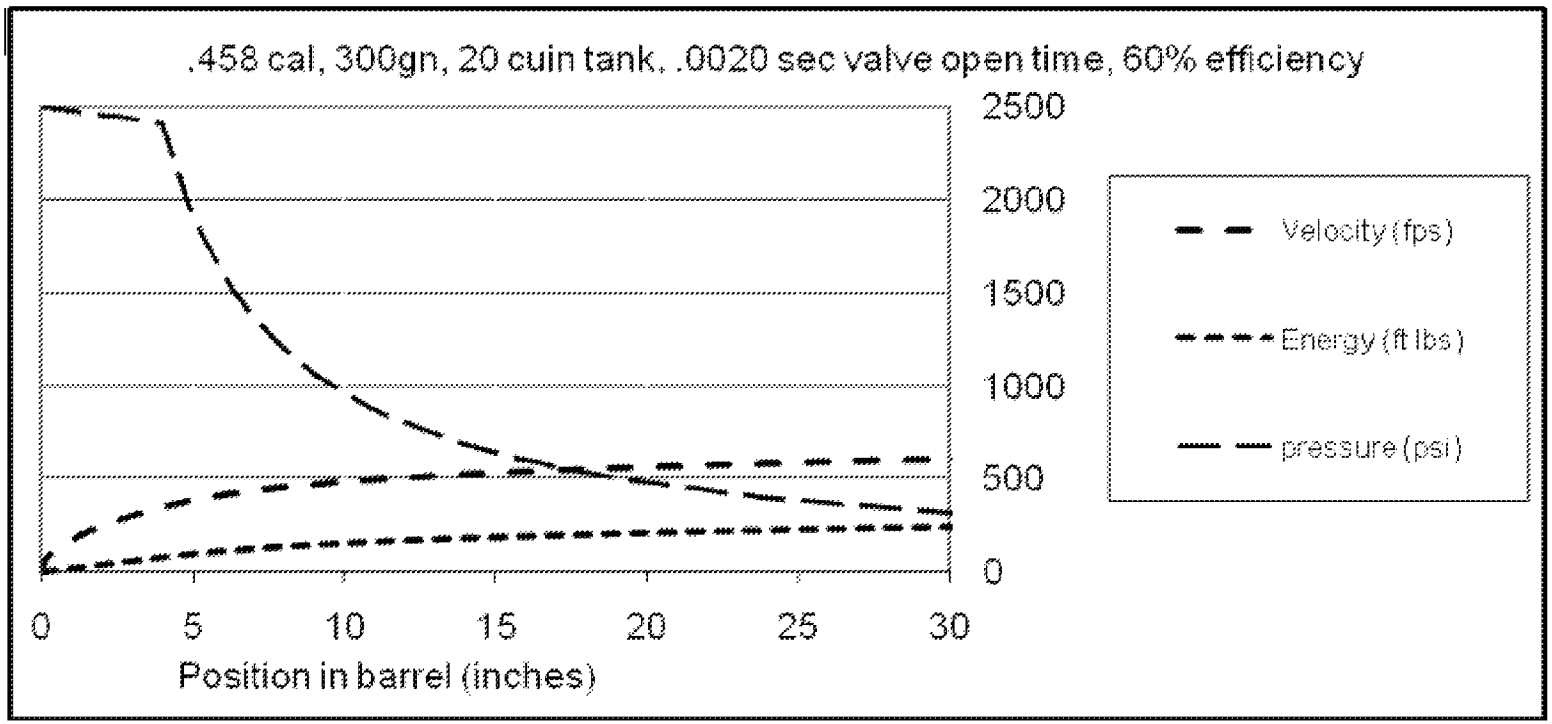
FIG. 14 is a graph of an exemplary embodiment of projectile velocity, projectile energy, and pressure vs. barrel position.
Figure 15:
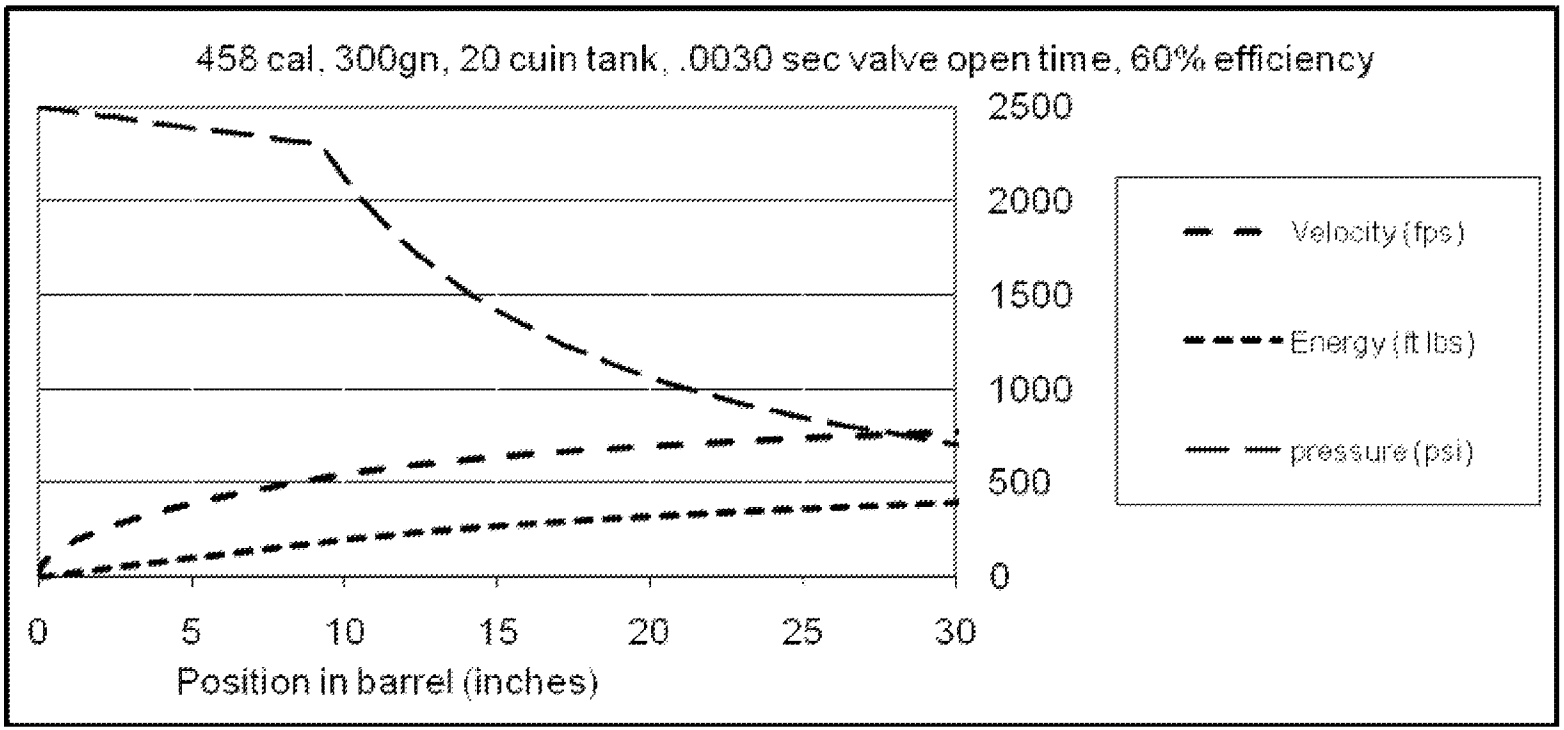
FIG. 15 is a graph of an exemplary embodiment of projectile velocity, projectile energy, and pressure vs. barrel position.
Figure 16:
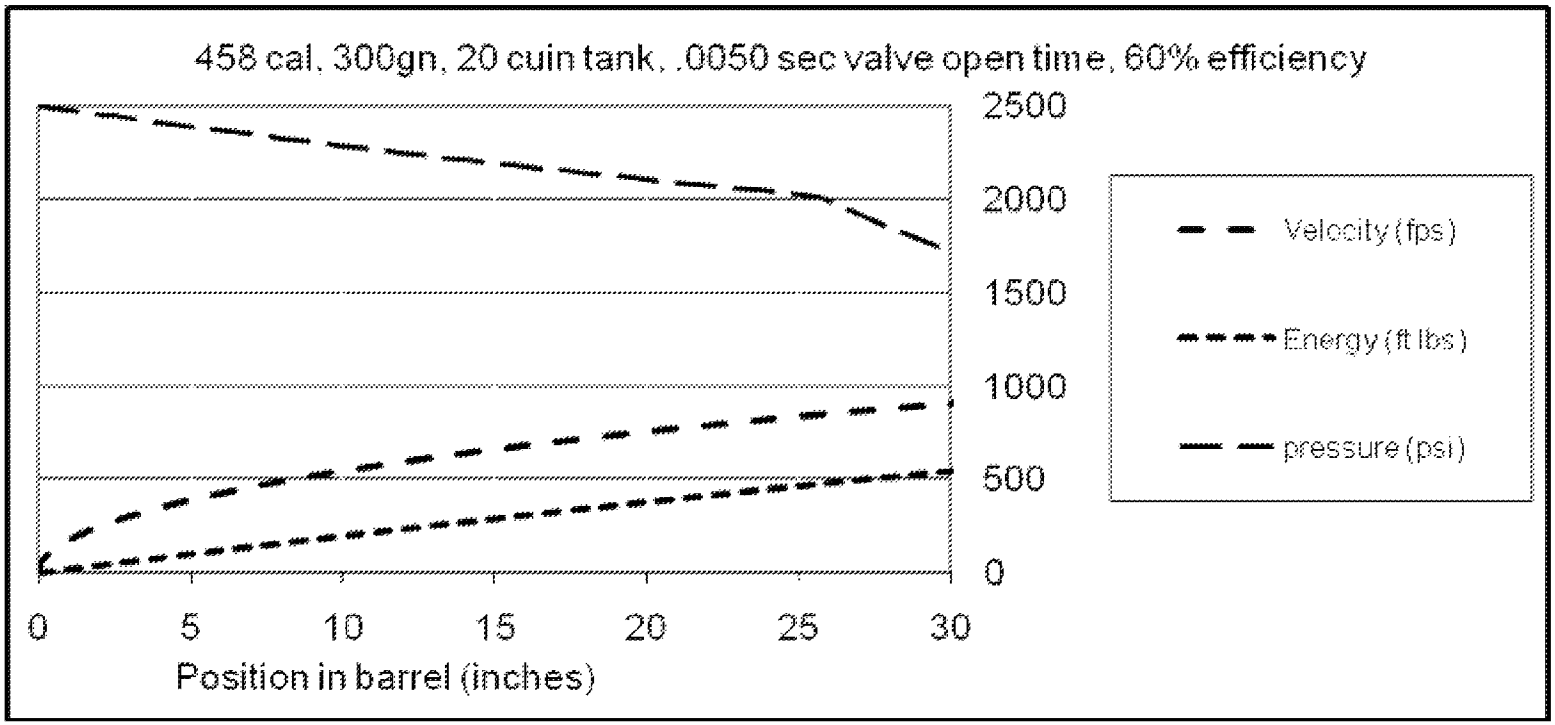
FIG. 16 is a graph of an exemplary embodiment of projectile velocity, projectile energy, and pressure vs. barrel position.

For each specific gun design and/or configuration, at least the weight of the projectile and the pressure of the motive gas can affect this open time, and thus, the velocity and/or kinetic energy of the fired projectile. See the exemplary graphs of FIGS. 14-16, which plot projectile velocity, projectile energy, and pressure vs. barrel position for various valve open times.

To determine the approximate energize time for the solenoid coils, and thus the approximate open time of the tube valve, the controller can monitor the pressure of the motive gas via a commercially available pressure transducer, the weight of the projectile, such as provided via user input, and the desired velocity and/or kinetic energy, such as provide via user input. The controller then can consult a look-up table (or similar data storage method) for an empirically-determined and/or calculated open-time value, and then energize the solenoid coil(s) for approximately that length of time.

Because there can be more than one variable, several two dimensional lookup tables can be used to cover the desired combinations of variables. The number of lookup tables can be determined by the desired granularity of control. The data for each lookup table can be developed through testing of the actual gun setup that will be used, using, for example, a chronograph. For example, for one particular gun setup (caliber, barrel length, piston diameter, tube valve size and/or flow characteristics, and/or solenoid pressure, etc.), there can be numerous look-up tables for various kinetic energy, velocity, weight, and/or pressure combinations. If the caliber or some other feature on the gun is changed, the values in the lookup tables might be different. The user input can determine which lookup table will be consulted. The controller then can read the pressure of the motive gas, match that pressure to the correct lookup table, and read the energize time for the solenoid coil(s). If, for example, one or more precise desired pressure, weight, velocity, and/or kinetic energy values are not available in the lookup tables, standard mathematical interpolation techniques can be used to determine the appropriate open time value. The coil(s) then can be energized for that time.

Certain exemplary embodiments can provide for balancing the timing and/or delivery of the motive gas to maintain an optimal firing, as the solenoid valve can control the duration of exposure of the high pressure motive gas to the projectile, thereby providing a repeatable launching of the projectile independent of the pressure in the high pressure supply. Certain exemplary embodiments can conserve the available high pressure gas and/or extend the available firings from a given remaining pressure of the high pressure gas.

Certain exemplary embodiments can provide a gun using a pneumatically charged tank to deliver energy for firing a projectile from the gun. Certain exemplary embodiments can include a pre-charged pneumatic (PCP) type air gun using a high pressure gas, such as air and/or carbon dioxide, in a rapid burst to accurately and/or consistently propel projectiles, such as those weighing from approximately 10 grains up to approximately 2000 grains or greater (including all values and sub-ranges therebetween), to a target located some distance away, such as at a distance of from approximately 10 feet to approximately 10,000 feet, including all values and sub-ranges therebetween.

Referring to FIGS. 1 through 5, shown is an exemplary gun, which can include a frame, an electronic control module 40, a solenoid valve 30, a sliding valve 1, a double acting piston 12, a power supply, and/or a high pressure tank 19.

The high pressure tank 19 can be located below a barrel 6 of the gun. Tank 19 can include a filling connector 21 located in an end plug 20. The end plug 20 can cooperate with a seal 60 for sealing the plug relative to the high pressure tank 19. The high pressure tank 19 and/or a receiver block 10 can include an access port selectively closable by an access plug 49. The access port can be sized to allow assembly and/or maintenance of components the gun.

The high pressure tank 19 can be a commercially available product and/or can be pre-filled from an outside source before operably engaging a frame of the gun. Alternatively, the high pressure tank 19 can be an integral part of the gun and/or can be filled while engaged with the frame or the gun. In selected configurations, the high pressure tank 19 can be fluidly connected to a high pressure gas reservoir in the receiver block 10. The high pressure tank can retain an operable gas pressure of motive gas of, for example, from approximately 100 psi to approximately 10,000, including all values and sub-ranges therebetween, such as at least approximately 2,500 psi, up to approximately 3,000 psi, over approximately 5,000 psi, and/or over approximately 8,500 psi. The gun can operate from the initial pressure of the high pressure gas down to approximately 800 psi to approximately 75 psi, including all values and sub-ranges therebetween, depending upon the selected mode of firing.

A rear seal O-ring 61 can provide a sealed interface between the receiver block 10 and the high pressure tank 19. At least one of the receiver block 10 and the frame can include a reservoir access port that can be selectively sealed by an access port plug and/or associated O-ring 62. The access port plug can retain a sensor 22, such as a pressure sensor, for providing a signal corresponding to a gas pressure in the high pressure tank 19. The pressure sensor 22 can be any construction known in the art.

The frame can include a stock 43, a barrel 6, a trigger, and/or a receiver block 10. Generally, a projectile can exit a barrel 6 through a muzzle 7 after being fired from a breech 8 due to the passage of high pressure gas from the high pressure gas tank 19.

The receiver block 10 can house the breech, the sliding valve 1, and/or the double acting piston 12. Receiver block 10 can interface the high pressure gas and a low pressure control gas.

The breech 8 can hold the projectile for firing and/or launching through and/or out of the barrel. The breech block, or sealable breech opening, can facilitate the loading of a projectile in axial alignment with the rear entrance of the barrel 6.

Figure 2:
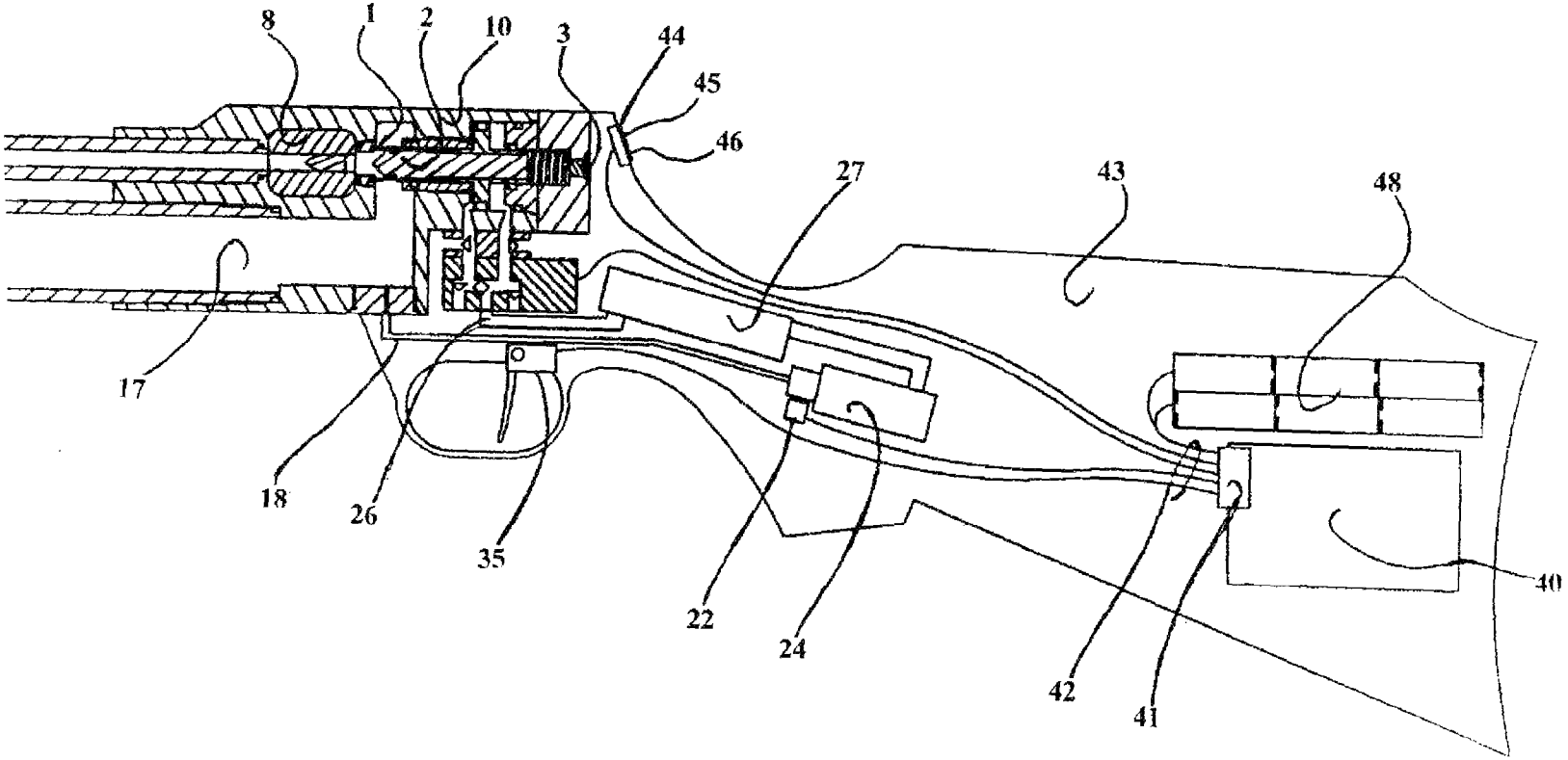
FIG. 2 is a detail side view of the exemplary air gun of FIG. 1.

As seen in FIG. 2, the breech 8 is shown between the closed sliding valve 1 and the rear end of the barrel 6. Any well-known breech side projectile loading mechanism can be employed for loading a projectile into the breech 8.

The frame can include a trigger, which can cooperate with a sensor, such as a pressure and/or motion sensor 34 (FIG. 7) and/or a switch such as a micro switch 35 (FIG. 2), which can be activated in response to movement of the trigger. Motion of the trigger can be sensed to initiate a firing procedure when a trigger signal is sent to the electronic control module 40.

The receiver block 10 can include an access port and/or an access cover plug 11 (FIGS. 1 and 4) or 16 (FIGS. 5, 7, and 8-11), which can selectively occlude the port, wherein the port can be sized for insertion of the sliding valve 1, and/or can cooperate with sealing O-ring 59. Resetting, maintenance, and/or replacement of the sliding valve 1 can be accomplished through the receiver block rear cover 16 that can be removed and/or opened.

The stock 43 can house the electronic control module 40 and/or the fluid passages interconnecting the high pressure tank 19, the regulator 24, and/or the solenoid valve 30. In certain exemplary configurations, the stock 43 can retain and/or contain the power supply, such as a battery pack 48, associated connector plug 41, and/or the wires 42 connecting the elements and/or the sensors to the electronic control module 40.

A gas pressure regulator 24 can be located within the frame, such as in the stock 43. The regulator can be fluidly connected to the high pressure tank by a high pressure line 18. The high pressure line 18 can have an inside diameter of approximately 0.030 inches to an inside diameter that approximates that of the high pressure tank, such as approximately 2.5 inches, including all values and sub-ranges therebetween. As seen in FIG. 2, a pressure sensor 22 can be located along the high pressure line 18, such as between the high pressure tank 19 and the regulator 24. The pressure sensor 22 can be operably located at the inlet of the regulator 24, wherein the pressure sensor can provide a signal to the electronic control module 40 corresponding to the pressure of the available high pressure gas. Thus, the pressure of the available high pressure gas can be monitored.

The regulator 24 can convert a portion of the gas at the motive pressure to a lower control pressure, thus providing a low pressure gas. The regulator 24 can be any of a variety of commercially available models such as those used in paint ball markers. Although there can be a number of available relationships between the pressure of the motive (high) pressure gas and the pressure of the control (low) pressure gas, in certain exemplary embodiments, the motive pressure can be generally greater than approximately 850 psi and/or the control pressure will be approximately 850 psi or less.

The gas pressure regulator 24 can be fluidly intermediate and/or connected to the high pressure gas, such as between the high pressure tank 19 and the solenoid valve 30. In certain exemplary configurations, a low pressure reservoir 27 can be fluidly intermediate the gas pressure regulator 24 and the solenoid valve 30. The gas pressure regulator 24 can convert a small volume of incoming high pressure gas to a larger volume of low pressure gas (control gas), which can power movement of the double acting piston and hence the sliding valve 1. In certain exemplary configurations, the regulator 24 can convert the high pressure gas to a control gas of from approximately 50 to approximately 500 psi (including all values and sub-ranges therebetween). The control gas can be passed to the low pressure line and/or ultimately to the double acting piston 12 through the solenoid valve 30.

Figure 7:
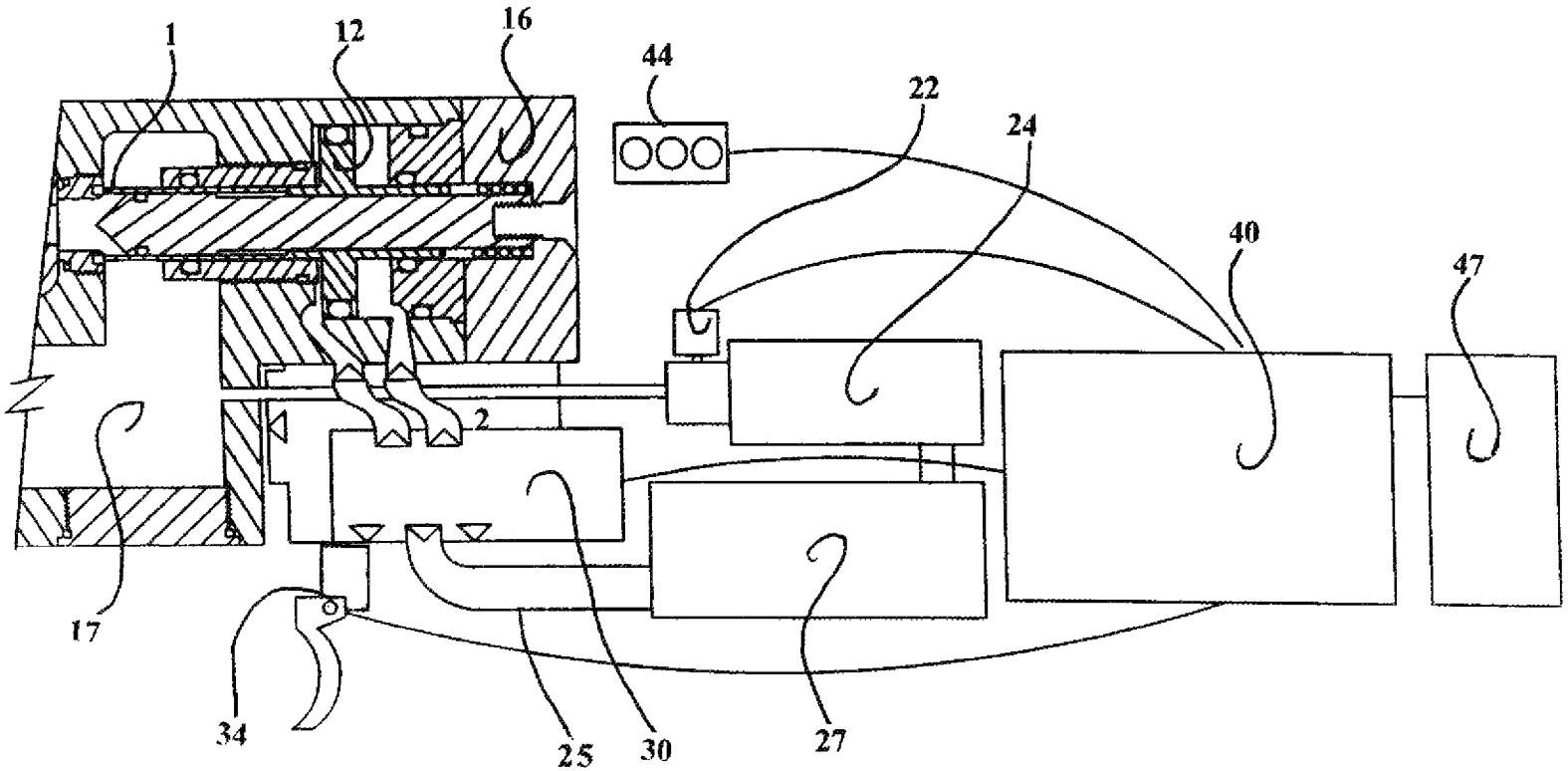
FIG. 7 is a detail view of a portion of an exemplary air gun.

A low pressure line 25 shown in FIG. 7 (shown as element 26 in FIGS. 2, 4, 10, and 11) can fluidly connect an outlet of the regulator 24 to the solenoid valve 30, wherein the low pressure reservoir 27 can be operably located along the low pressure line.

The solenoid valve 30 can be fluidly connected to the low pressure gas from the regulator 24 and/or can be operably connected to at least the electronic control module 40, and/or depending upon the particular configuration, the power supply. The solenoid valve 30, which can be available in several commercial configurations, can operate as one, or more, solenoid valves. Potentially satisfactory valves can include MAC® brand valves by Mac Valves Inc. such as a pair of 33 Series valves or a single 44 Series valve.

Figure 4:
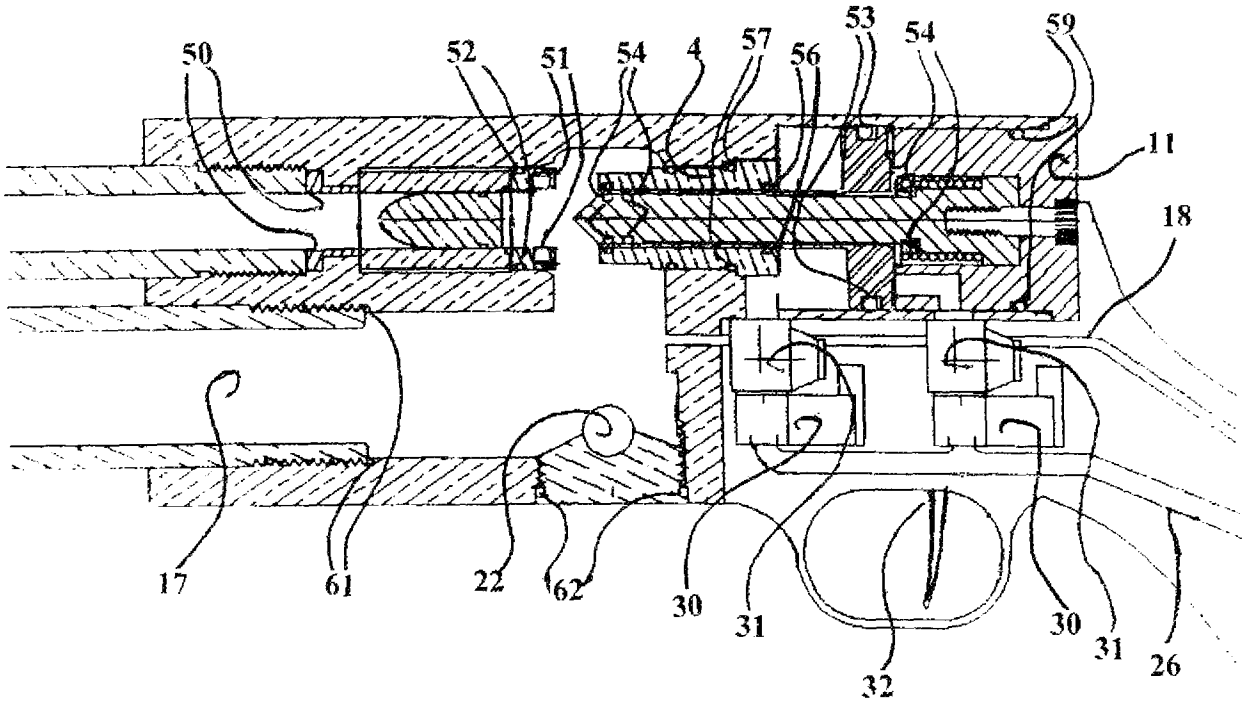
FIG. 4 is a detail view of an alternative construction of a portion of an exemplary air gun.
Figure 5:
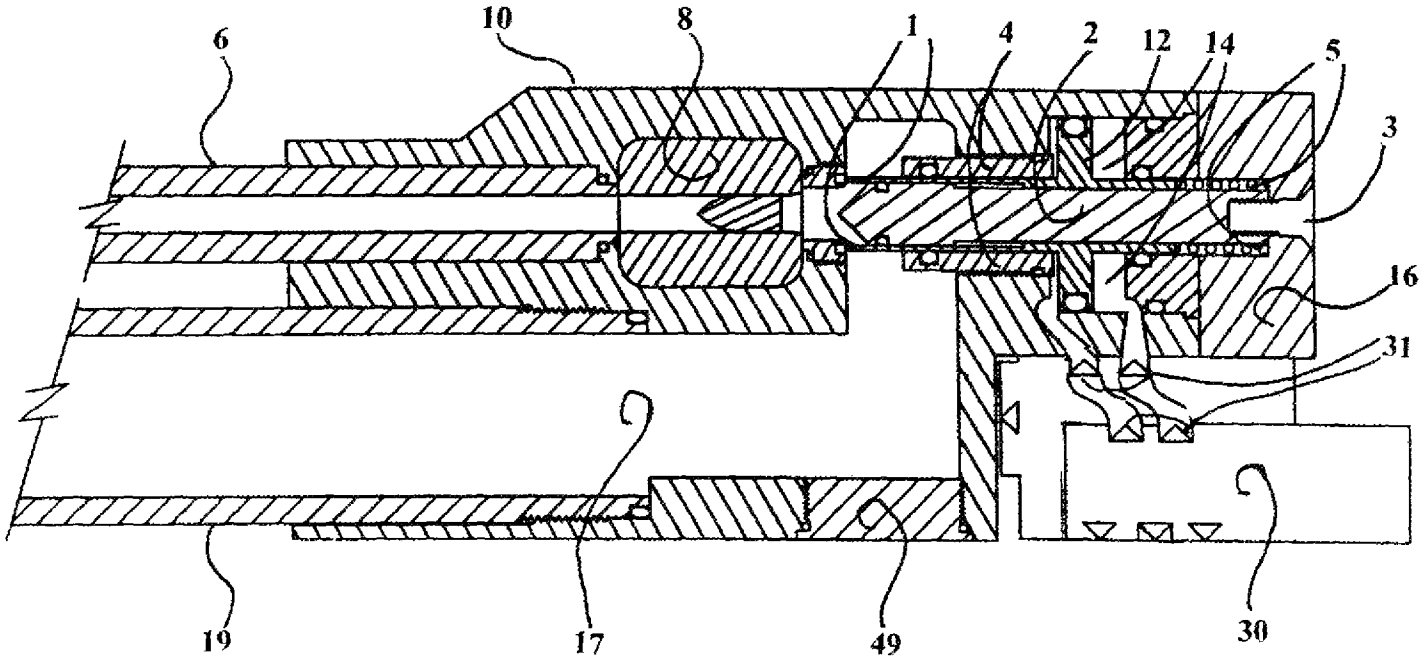
FIG. 5 is a close up side view of an exemplary receiver block.

One or a plurality of solenoid valves 30 can be employed in certain exemplary embodiments. In a single solenoid valve configuration, the solenoid valve can be of a 5 port type, such as shown in FIGS. 5, 10, and 11. Alternatively, the solenoid valves can include two solenoids of the 3-port type fitted into the circuitry, such as shown in FIG. 4, as can other solenoid types. A plurality of independently timed solenoid valves can be employed to control the exposure of the double acting piston (sliding valve) to low pressure gas, wherein a solenoid valve can open the sliding valve, and a second solenoid valve can close the sliding valve, by acting on the respective portion of the double acting piston.

In certain exemplary configurations, none, one, or two quick exhaust valves 31 can be fluidly intermediate the solenoid valve 30 and the double acting piston 12. Potentially satisfactory quick exhaust valves 31 can include the Humphrey SQE exhaust valve from Humphrey Products Company. The quick exhaust valves 31 can be operably disposed in the low pressure line 25 between the solenoid valve 30 and the front chamber 13 and the rear chamber 14 of the double acting piston 12. The quick exhaust valves 31 can be in line between a port on the solenoid valve 30 and the low pressure reservoir 27. During pressurization, the low pressure gas can flow through the quick exhaust valve 31 without interruption. When the exhaust port of the solenoid valve 30 is closed, the drop in pressure in the quick exhaust valve 31 can cause the quick exhaust valve to open and/or vent the exhaust from the cylinder directly into the atmosphere. Consequently, the exhaust gas does not necessarily pass through the solenoid valve 30 and thus the exhausting can be faster. The quick exhaust valves 31 can reduce the exhaust cycle time of the double acting low pressure piston and/or can improve the response time of open/close cycle of the valve. Depending on the volume of the double acting piston, quick exhaust valves can be an optional component.

The sliding valve 1 can be movable between a forward (toward the barrel), closed position, which can preclude the passage of high pressure gas, and a rearward open (firing) position, which can permit the passage of high pressure gas from the high pressure tank to the breech 8. The sliding valve 1 can be positioned by a guide and/or bushing 4 retained within the receiver block 10, which can maintain sliding action of the valve 1 between the open position and closed position.

Referring to FIG. 5, the sliding valve 1 is shown in the closed position, in which it can form a gas tight seal against the high pressure gas in the high pressure tank 19.

In certain exemplary configurations, the sliding valve 1 generally can be tubular and/or sleeve shaped having a central passage, wherein the central passage can be sized to slidingly receive a fixed center core 2. The center core 2 can be captured by a retaining screw 3 to position and/or lock the center core in place, which can facilitate the accurate and/or controlled opening and/or closing of the sliding valve 1. The sliding valve 1 can linearly translate in a sealed relation along the center core 2 between the open, firing position and the closed position. The center core 2 can absorb rearward force of the high pressure gas during the firing of the gun. In certain exemplary configurations, the sliding valve 1 can be located in axial alignment with the barrel directly behind the breech 8.

In certain exemplary configurations, when viewed along its longitudinal axis, the sliding valve 1 can have a reduced frontal area, such as in the shape of a narrow annular ring, such that the force needed to close the sliding valve, and/or to stop the flow of high pressure gas from the high pressure reservoir, can be reduced. Because the sliding tubular valve can present only a relatively thin annular facial surface to the high pressure gas, while the fixed center core can present a larger facial surface area, the force of the high pressure gas urging the sliding valve to the open position can be reduced compared to the entire longitudinal force imposed by the high pressure gas on the combined valve face and core face. The reduced sealing area of the sliding valve 1, such as by the annular sealing area, can reduce the required forced to maintain the necessary seal by approximately 80% from that of a standard solid cylindrical valve seat. The sliding valve 1 can define a circumferential gap through which the high pressure gas from the high pressure reservoir can pass upon the sliding valve being disposed in the open position. The reduced sealing area of the sliding valve 1 can reduce the force acting on the sliding valve against the area and/or can provides for the sliding valve to rapidly close so as to control the pulse of high pressure gas. For example, if the high pressure gas was at a pressure of approximately 3,500 psi, and the valve had a continuous circular front face and/or area having an approximately 0.500 inch diameter, the closing force required could be approximately 687 pounds. However, if sliding valve 1 had an annular front face and a 0.030 inch wall thickness of that annulus, it could require only 155 pounds of closing force to overcome the longitudinal force imposed on the sliding valve by the high pressure gas, as the remaining longitudinal force created by the high pressure gas would be imposed on the face of the fixed center core. Because typical valve open times can be between approximately 2 and approximately 8 milliseconds, reducing the closing force can make possible the control of the burst of high pressure gas. The sliding valve 1 can have a shaped front, frontal point, frontal face and/or frontal edge that smoothly and/or laminarly directs air into the breech (rather than a shape that creates substantial turbulence and/or drag that might hinder near-instantaneous closing of the sliding valve), which can reduce drag and/or facilitate expedient closing of the sliding valve.

The sliding valve 1 can be positioned about and/or to circumferentially surround at least a portion of the fixed center core 2 and/or can be sealed by sealing O-rings 54 in a plurality of locations. As the sliding valve 1 slides upon the center core 2, an outer valve guide bushing 4 can cooperate with outer guide seals 57, and/or can preclude passage of the high pressure gas into the chambers of the double acting piston.

Referring to FIG. 4, an alternative configuration is shown wherein a barrel sealing O-ring 50 can be disposed between the barrel 6 and the breech 8 and/or can serve to provide a gas tight connection to the projectile breech block. A bushing sealing O-ring 52 and a sliding valve face seal 51 can provide a gas tight connection with the sealing surface of the sliding valve 1 when the sliding valve is in the closed position.

The sliding valve 1 can include and/or can be operably connected to the movable double acting piston 12. Movement of the sliding valve 1 between the open position and the closed position can be provided by the double acting piston 12. The double acting piston 12 can cooperate with outer dynamic seals 53 and/or can preclude the leakage and/or passage of regulated pressure gas.

The double acting piston 12 can be operably connected to the sliding valve and/or can be integrally connected to and/or formed with the sliding valve 1 so as to control positioning of the sliding valve. The double acting piston 12 can drive the sliding valve 1 between the open, firing position of the sliding valve and the closed position of the sliding valve. The double acting piston 12 can be moveably connected to the center core 2 between a forward position, which can correspond to the closed position of the sliding valve 1, and a rearward position, which can correspond to the open position of the sliding valve.

In certain exemplary configurations, a bias mechanism, such as spring 5, can act on the double acting piston 12 and/or can urge the piston to the forward, closed position, thus urging the sliding valve to the forward closed position. As seen in FIGS. 4, 5, and/or 8-11, the spring 5 can be disposed between the receiver block back cover 11 or 16, and the double acting piston 12.

The double acting piston 12 can be fluidly connected to a front chamber 13 and a rear chamber 14. Each of the front chamber 13 and the rear chamber 14 can be selectively fluidly connected to a regulated low pressure gas and/or the quick exhaust valve 31. The solenoid valve 30 can control the valving providing the selective fluid communication to each of the front chamber 13 and the rear chamber 14.

In the closed position of the sliding valve 1, the double acting piston 12 can be acted on by a pressure of the control gas in the rear chamber 14, as the rear chamber is fluidly connected to the low pressure gas, the control gas, by the solenoid 30 and the spring 5.

In the rearward position of the double acting piston 12 (and hence open firing position of the sliding valve 1), the double acting piston can be acted on by low pressure gas in the front chamber 13 as introduced by the solenoid valve 30.

In certain exemplary configurations, the electronic control module 40 can be removably and/or replaceably disposed within the stock 43. The electronic control module 40 can be removed and/or replaced for service and/or upgrade as needed. The electronic control module 40 can be operably connected to the sensors 22, the solenoid valve 30, the power supply, a user interface 44, control and/or mode selection buttons 45, and/or any associated visual indicators such as LED or LCD visual indicators 46.

The power supply 48 can be any of a variety of configurations, including but not limited to a disposable or rechargeable battery, wherein a connector can operably engage the power supply with the remaining components, such as the solenoid valve 30.

The electronic control module 40 can be configured to control operation of the solenoid valve 30 and/or to vary a duration of exposure of the breech 8 to the high pressure gas, and thereby control the exit velocity and energy of the projectile.

The electronic control module 40 can include a timer and/or counter, which can independently control the operation of the solenoid 30, and hence the double acting piston 12 and the sliding valve 1. The electronic control module 40 can calculate and/or adjust the timing of the solenoid valve 30, or multiple solenoids, such as based upon the selections by the user of the gun.

The electronic control module 40 can receive data from the connected sensors 22. The electronic control module 40 can provide visual, audible, and/or haptic feedback of received data, related settings, sensor readings, and/or its calculated outputs to the user, such as through the user interface and/or separate indicators and/or actuators. For example, the electronic control module 40 can provide, via the user interface, an indication of the available high pressure gas energy level for firing a projectile and/or the maximum number of remaining firings at the selected power level.

In certain exemplary configurations, the electronic control module 40 can monitor a power level of the power supply and/or provide a signal indicating a remaining power supply to the user interface means.

Figure 12:
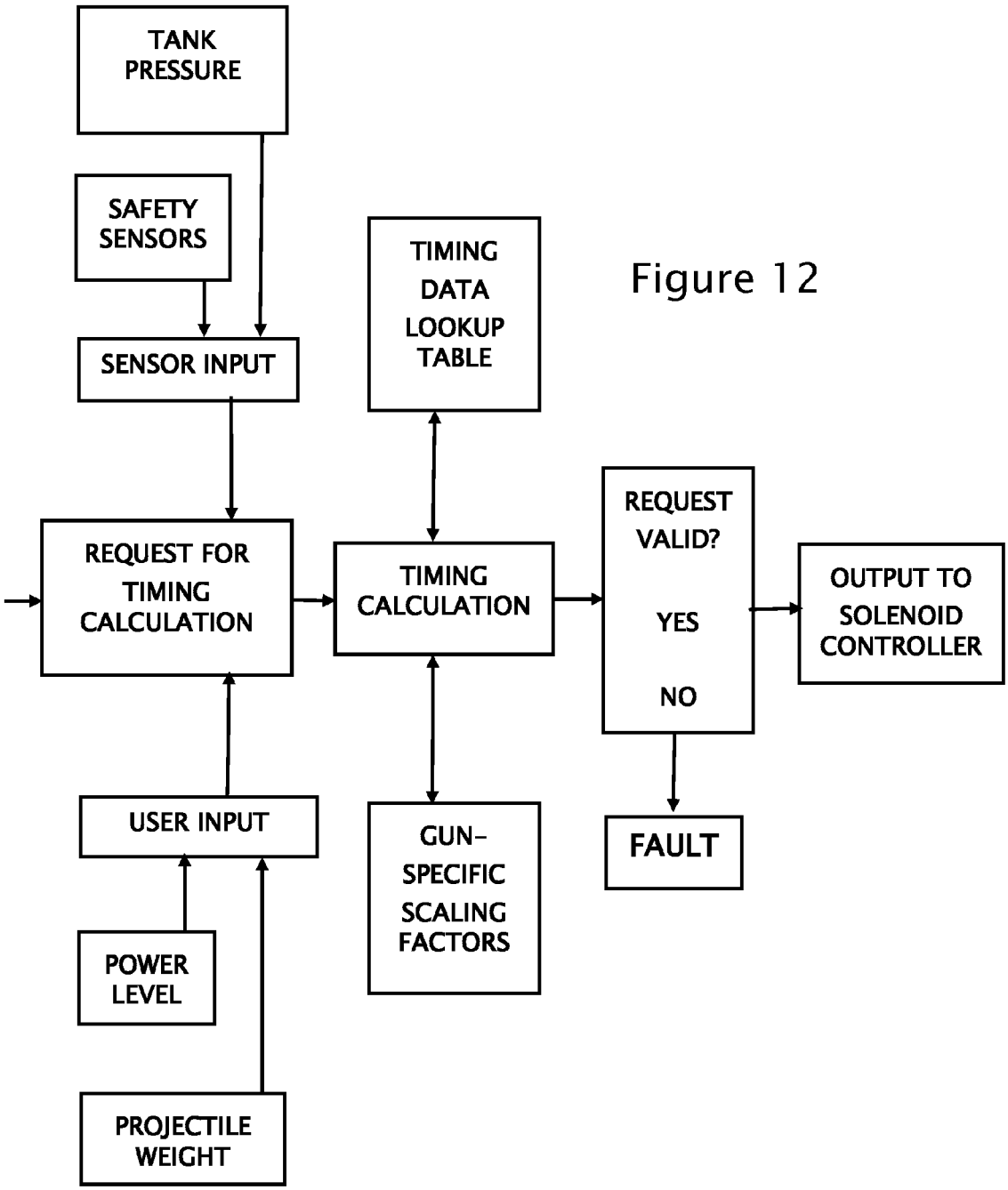
FIG. 12 is a flow chart of an exemplary algorithm for controlling an exemplary air weapon.

The electronic control module 40 can include a microprocessor configured to analyze the sensor inputs and/or programmed to calculate a corresponding timing for the solenoid valve 30. The electronic module 40 can provide corresponding voltage impulses to the solenoid 30 to achieve the desired timing. Referring to FIG. 12, a flow chart of an exemplary algorithm for the electronic control module 40 is shown.

The inputs to the electronic module 40 can include:

- A first input signal that can correspond to actuation of the trigger such as from the trigger sensor. The trigger signal can initiate the calculating, timing, and/or firing sequence from the electronic control module 40.
- A second input signal that can correspond to the sensed pressure from the pressure sensor 22. This signal can be used by the electronic control module 40 to determine the necessary duration of sliding valve in the open position. That is, the duration of the sliding valve 1 in the valve open position can be at least partially determined by the available pressure of the high pressure gas.
- A third input signal can correspond to one or more settings of the mode selection switch, which can include parameter settings such as a desired power level for the next round. User input signals can correspond to, for example, a user selected energy level desired for the firing event, which can be selected in recognition of the, for example, different weights, distance, accuracy, and/or calibers, etc., that can be offered, any of which can be set and/or selected by the user. Any of a variety of interfaces can be provided including, but not be limited to, a rotary switch, dial selector, and/or slide indicator that allows the user to set the energy level appropriate for the projectile and/or firing event.

Figure 6:
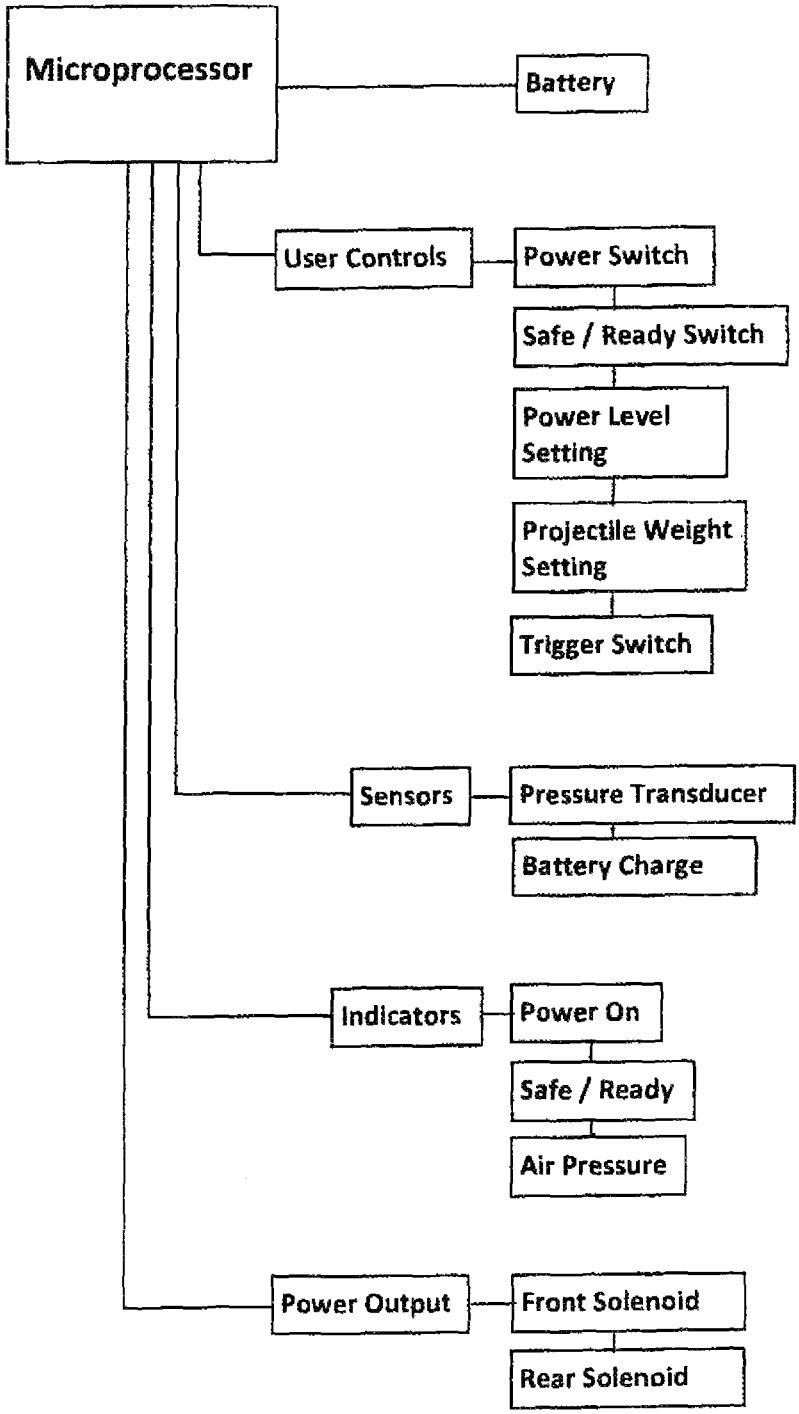
FIG. 6 is a schematic representation of an exemplary functionality control of an exemplary air gun.

Referring to FIG. 6, exemplary functions of exemplary electronic control module 40 are shown in a diagrammatic chart, which, starting at the top, shows the electronic control module coupled to the power supply. The next function shown is the user controls that can provide the user interface 44 (wherein the user interface 44 can include selector buttons 45 and/or the visual indicators, such as light emitting diodes 46 for a visual confirmation of user commands and/or selections) for the gun, the functions potentially including:

- the power switch for off and on;
- an indicator of safety position and/or ready to fire status, such as an LED controlled through the electronic control module 40 in response to a limit switch on the bolt of the gun;
- an indicator of power level setting, which can indicate the available pressure of the high pressure gas;
- an indicator and/or setting of a projectile weight; and/or
- a trigger switch (such as motion and/or pressure sensor), which can indicate the user decision to fire the gun by squeezing the trigger 32.

The next displayed function is the sensors that can return relevant data to the electronic control module 40, of which, those indicated can include:

- a pressure of the available and/or remaining high pressure gas—such as from the pressure sensor 22; and/or
- an available power supply level.

The following visual and/or auditory indicators can be provided to the user:

- a power on and/or power status;
- a safety and/or ready status; and/or
- an indicator of the remaining available high pressure gas.

In selected exemplary configurations, the electronic control module 40 can provide an indication of a power output corresponding to the solenoid valve 30, which can include a first solenoid and/or a second solenoid, such as:

- a front solenoid valve; and/or
- a rear solenoid valve.

Sensors can be included to give indicators and/or settings to the user of the gun, such as:

- the number of shots taken, such as calculated by the electronic control module 40 and/or displayed on an LCD;
- the number of shots remaining, such as calculated by the electronic control module 40 and/or displayed on the LCD;
- a breech-open sensor, such as a limit switch;
- a power supply charge level indicator;
- sensor errors for maintenance and/or replacement, such as in response to diagnostic routines in the electronic control module; and/or
- available low pressure gas indicator.

In conjunction with the user interface and/or input, the electronic control module 40 can provide for the selectable and/or adjustable control of the launch of a projectile. The electronic control module 40 can determine the firing parameters to maximize the number of firings for a remaining pressure of high pressure gas. The determination by the electronic control module 40 can be made prior to or in response to movement of the trigger 32.

Prior to firing, the high pressure tank 19 can be filled and/or partially filled with high pressure gas. The pressure can be as high as, or greater than, approximately 3,500 psi, although the gun can operate at lower pressures, such as at approximately 1,000 psi or even less, such as for smaller projectiles.

In operation, before any operation begins, the power supply 48 can be adequately charged so that the electronic control module 40 and/or the solenoid valve 30 can function.

The sliding valve 1 can be in the forward, closed position in response to at least the spring 5 and/or the presence of the control pressure gas in the rear chamber 14. Solenoid valve 30 can be set to introduce low pressure gas into the rear chamber 14 and/or evacuate the front chamber so that the resulting pressure differential on the double acting piston can urge the sliding valve 1 to the closed position. In the closed position, the sliding valve 1 can preclude the high pressure gas from the tank 19 from entering the breech.

The electronic control module 40 can be provided the user selected desired energy and/or power level (such as by energy and/or velocity or desired distance). Alternatively, the electronic control module 40 can employ a default setting for the relevant parameter of projectile launching.

In this idle state the solenoid valve 30 need not be electrically energized, and/or the gun can be in a non-firing state. This can ensure that if the battery pack has been removed, and/or if electrical power has been lost, the gun need not fire unintentionally. In the idle state, the low pressure gas passage to the rear chamber 14 of the double acting piston 12 can maintain a normally open state so that the low pressure gas can remain within the chamber and/or keep the double acting piston pressing the sliding valve 1 to the closed shut position. The sliding valve 1 can rely upon the spring 5 and/or a lock, if desired, to keep the sliding valve closed during the initial filling operation of the high pressure tank. The air circuitry, and/or the electronic control module 40, can be selected such that the normal, idle state of the system can keep the sliding valve 1 in a closed position. Because the solenoid valve 30 that can pass the control pressure to the rear chamber 14 can be normally open, and/or the solenoid valve that can feed the control pressure to front cylinder 13 can be normally closed, a de-energized state of the solenoid valves can allow air pressure from the regulator 24 to keep the high pressure gas forcing the sliding valve 1 shut. Because the control pressure can come from the regulator 24, which in turn can be fed by the high pressure tank 19, so long as there is high pressure gas in the high pressure tank, there can be control pressure to keep the sliding valve 1 in the closed or shut position. The bolt mechanism of the gun can include a locked and/or safe position that can physically lock the sliding valve 1 in the shut position.

Before initiation of any firing sequence, the main on-off switch that supplies power to the electronic control module 40 can be turned on to energize and/or indicate the control readiness of the module. When the mode selector switch is turned on, there can be an indicator showing activation and/or the selection of a desired energy level to be delivered for the firing of a projectile. The user selected settings, as available, can indicate and/or confirm their readiness. When visual indicator light emitting diodes (LED) are used, they can be displayed in a pattern indicating their 'ready state'. The user selection and/or the visual indicators can be available in several different types, any of which can perform the same indicator function for the user. That is, the user interface 44 can allow the user to verify power levels and/or settings for projectile caliber and/or weight, and/or allow the electronic control module 40 to establish the range and/or power with the available high pressure gas as sensed by the pressure sensor 22, potentially with the regulator 24 delivering the low pressure control gas to the solenoid valve 30 (and/or low pressure reservoir 27).

In the certain exemplary configurations, a projectile can be manually and/or automatically loaded into the breech 8 for firing. The sliding valve 1 can be in the forward closed position, which can preclude passage of high pressure gas to the breech 8.

FIG. 7 shows an enlarged side view of an exemplary operation of the sliding valve 1, which is shown closed in conjunction with the double acting piston 12. As seen in the Figure, the front chamber 13 can be vented and/or functionally closed, and/or the rear chamber 14 can be fluidly connected to the solenoid valve 30 and/or exposed to the low pressure gas from the regulator, which can urge the piston to the forward position and/or the sliding valve 1 to the closed position. In this closed state, the sliding valve 1 can preclude passage of the high pressure gas and/or the gun can be in a non-firing safety mode. At rest, the trigger sensor can remain in a sleep mode, and/or the sliding valve 1 can remain closed and/or locked into the closed position, which can preclude passage of the high pressure gas to the breech.

Figure 8:
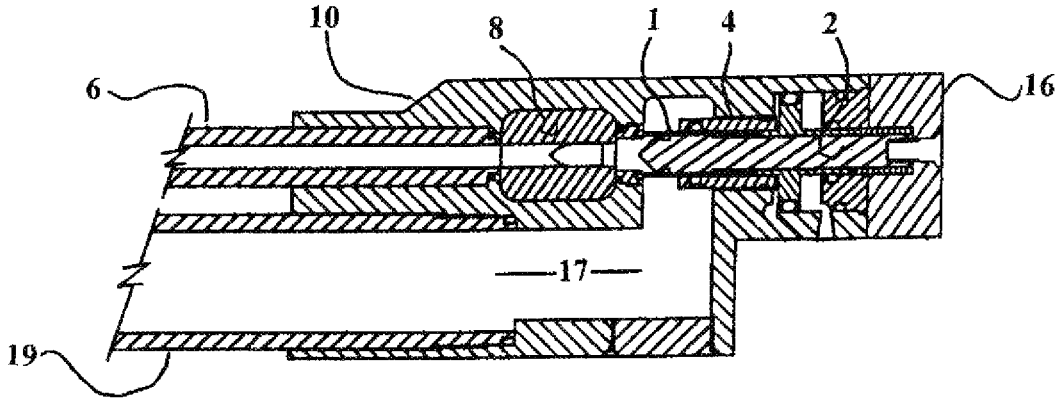
FIG. 8 is a cross sectional view showing a closed position of an exemplary sliding valve.
Figure 9:
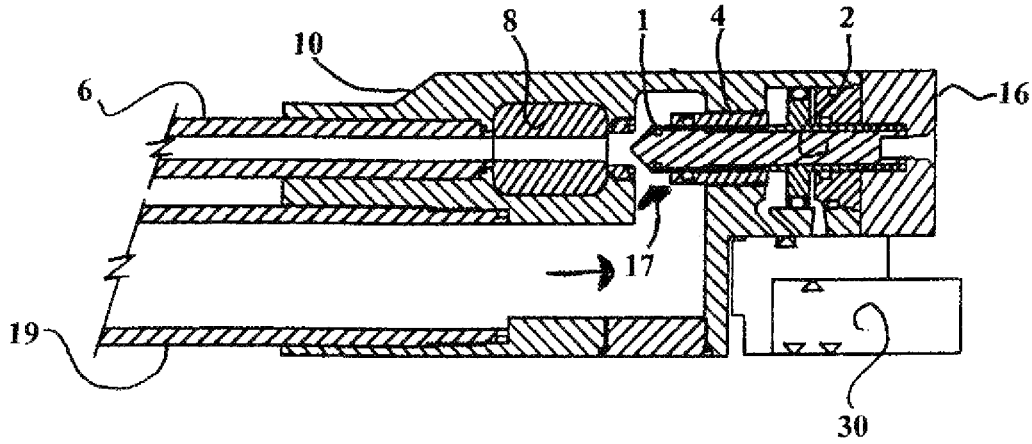
FIG. 9 is a cross sectional view of the exemplary sliding valve of FIG. 8.

The state of an exemplary sliding valve 1 is shown in the FIGS. 8-11, which show an exemplary gun in a safety mode and a firing mode. FIGS. 8 and 9 show the barrel 6 fitted into the receiver block 10 and containing a projectile in the breech 8, and the sliding valve 1 in the closed position. The sliding valve 1 can slide to the closed and/or open position within guide 4 and/or upon the center core 2, such as in response to movement of the double acting piston 12 from the low pressure gas, which can be delivered by the solenoid valve 30. The double acting piston 12 can move in response to the delivery of low pressure gas to the rear chamber 14, which can drive the sliding valve 1 closed tightly shut, and/or to the delivery of low pressure gas to the front chamber 13, which can allow the sliding valve 1 to move the open position, which can admit a burst of high pressure gas from the high pressure tank 19.

In FIG. 8 the sliding valve 1 is shown closed, and in FIG. 9 the sliding valve 1 is shown open.

In FIGS. 7 and 10, the sliding valve 1 is shown in the closed position, having been slid forward upon the center core 2 and aligned within the guide 4. The double acting piston 12 is shown forcing the sliding valve 1 closed as in FIG. 10, or open for firing of a projectile out of the barrel 6 as in FIG. 11. The closed sliding valve 1 can be forced and/or maintained closed by the double acting piston 12, such as in response to the low pressure gas, via the solenoid, in the rear chamber 14 and the spring 5. The rear chamber 14 can be filled with the low pressure gas from the solenoid valve 30 in response to signals from the electronic control module 40.

Initiation of a firing sequence can begin with actuation of the trigger 32 as the trigger is squeezed, which can activate the trigger increasing pressure module 34 and/or a limit switch, which can provide a signal to the electronic control module 40.

Figure 3:
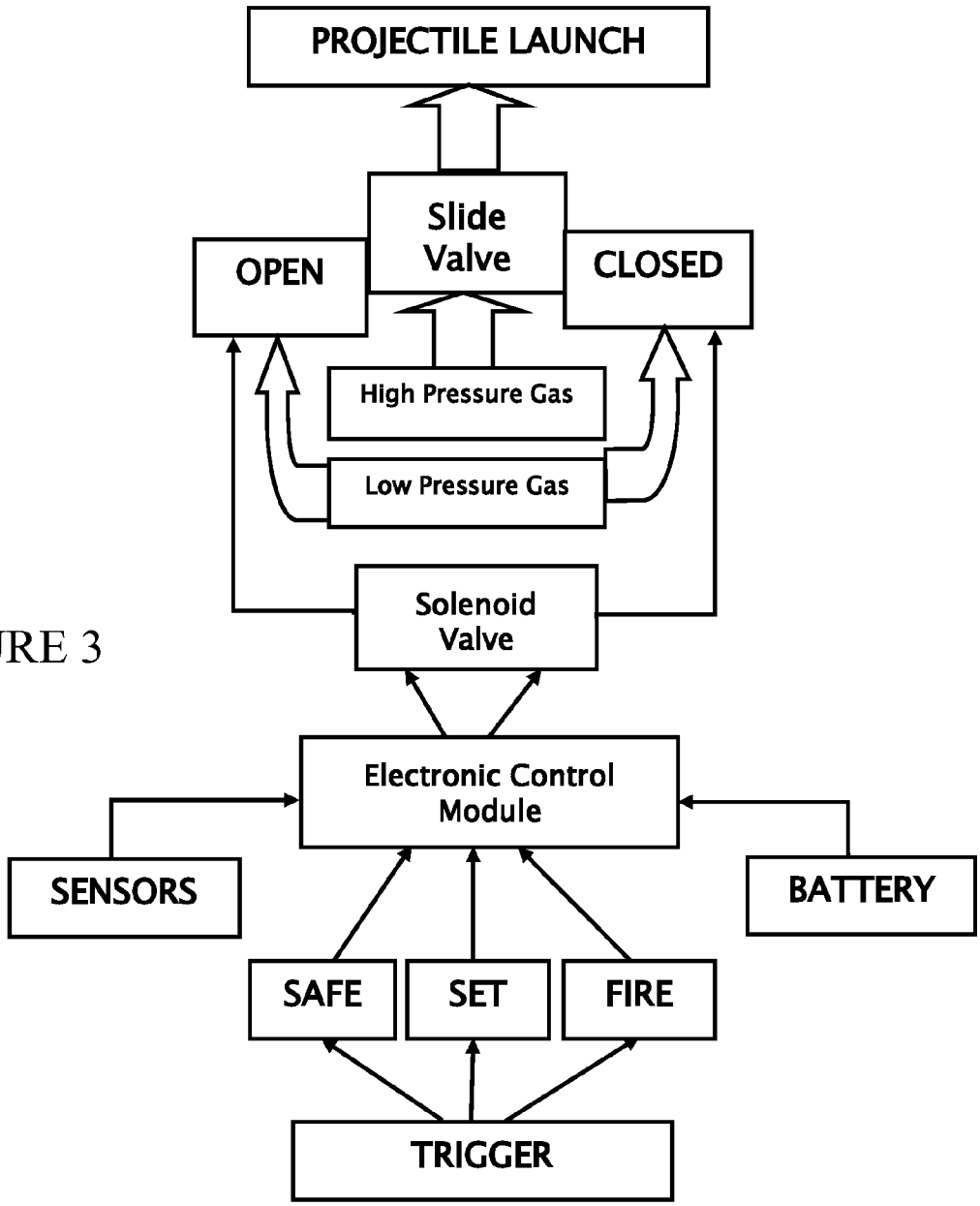
FIG. 3 is a schematic of an exemplary operation of a portion of an exemplary air gun.

FIG. 3 provides a diagrammatic chart showing an exemplary projectile firing through the actions of exemplary sliding valve 1, such as powered by the high pressure gas to fire, and/or the low pressure gas to open and/or close the valve. When the trigger increasing pressure module 34 is squeezed and/or activated to fire, the microprocessor module 40 can direct that the tubular valve 1 open, which can allow a burst of high pressure gas to fire the projectile out of the barrel 6.

To initiate the actual firing sequence, the user can start pulling the trigger. Movement of the trigger can change the electrical state of the trigger switch (and/or sensor), which in turn can send an electrical signal to the electronic control module 40. The firing mode can be initiated when the trigger increasing pressure module 34 is activated by the user squeezing the trigger.

The electronic control module 40 can immediately read the settings on the mode selector switch and/or the pressure of the available high pressure gas from the sensor 22. In response to the mode switch power level setting and/or the available high pressure gas, the electronic control module 40 can calculate the timing for the opening of the sliding valve 1 to deliver a volume of high pressure gas to propel the projectile out of the barrel at the selected energy level. The electronic control module 40 can calculate the required timing of the solenoid valve 30 for passing regulated low pressure gas to and/or from the double acting piston 12, and/or can activate the solenoid valve accordingly.

The duration of exposure of the breech 8 to the high pressure gas and/or the energy imparted to the projectile typically can be calculated before the trigger is completely pulled. That is, the burst of high pressure gas from the high pressure tank 19 can be automatically calculated prior to passage of the motive gas past the sliding valve, and/or can be controlled through the electronic control module 40, such as to consistently deliver the selected energy for as many shots as is possible and/or requested.

As the user continues to pull the trigger, the state of the trigger switch again can change, which can cause the electronic control module 40 to send an electrical pulse or pulses to the solenoid valve 30. Although a two step trigger can be used without imparting a detrimental lag, a single stage trigger can be employed. In a single solenoid configuration that utilizes a single two pole position with five ports, such a solenoid valve can be energized so that the low pressure gas that normally remains in the rear chamber, which can keep the double acting piston in the forward position and/or the sliding valve 1 closed, can be quickly exhausted through the rear chamber quick exhaust valve 31.

Then, the solenoid valve 30 can direct low pressure gas to the front chamber 13 of the double acting piston 12, which can cause the piston to move to the rear position and/or the sliding valve 1 to open, which can pass high pressure gas and/or allow that gas to enter the breech 8 and/or propel the projectile out of the barrel 6.

The high pressure gas can reach the front face of the sliding valve 1 and/or the additional force of the high pressure gas can contribute to the opening force on the sliding valve.

In the FIG. 11, exemplary sliding valve 1 is shown open (as shown open in FIGS. 4, 9, and 11) and the high pressure gas can pass the sliding valve 1 to the breech, which can push the projectile out through the barrel 6.

During the firing event, the pressure from the high pressure tank 19 can be applied directly to the rear end of the projectile without being regulated to a lower pressure. This burst of high pressure gas can provide for the maximum possible acceleration of the projectile out of the barrel 6.

Before the projectile exits the muzzle of the barrel 6, which can be in from 1 to 100 milliseconds, including all values and sub-ranges therebetween, such as in approximately 8 milliseconds, less than approximately 15 milliseconds, less than approximately 27 milliseconds, less than approximately 33 milliseconds, and/or less than approximately 49 milliseconds, etc., the closing of the sliding valve 1 and/or the shutting off of the high pressure gas typically can be initiated. To close sliding valve 1, the force of the high pressure gas on the front face of the valve can be overcome. To reduce the force needed to close the sliding valve 1, the rigid center stationary core 2 can be positioned and/or sealed gas tight in the center axis of the sliding valve. Thus, the high pressure gas can act on a reduced front surface area of the sliding valve 1.

The venting of the front chamber 13 and/or passage of low pressure control gas to rear chamber 14 which can move the double acting piston and/or the sliding valve 1 to the closed position (as is shown in FIGS. 1, 2, 5, 7, 8, and 10), can be controlled by the solenoid valve 30, which in turn can respond to the electronic control module 40.

At approximately a calculated and/or determined time (such as when the projectile passes along the barrel), the solenoid valve 30 can de-energize, which can rapidly exhaust the low pressure gas from the front chamber 13 of the double-acting piston 12 through the front quick exhaust valve 31.

At approximately this time, the solenoid valve 30 can expose the low pressure gas to the rear chamber 14 against the double acting piston 12, which can urge the piston and/or sliding valve 1 to the closed position, which can preclude passage of the high pressure gas into the breech.

By controlling the open time of the sliding valve 1, the energy level selected for the launch of the projectile can be controlled. The open time interval for the sliding valve can be less than approximately 5 milliseconds to less than approximately 50 milliseconds, including all values and sub-ranges therebetween, such as less than approximately 8 milliseconds, less than approximately 12 milliseconds, less than approximately 15 milliseconds, and/or less than approximately 20 milliseconds, etc. In certain exemplary configurations, the open state of the sliding valve can be controlled to within approximately 0.005 milliseconds to approximately 0.1 milliseconds, including all values and sub-ranges therebetween. The open state of the sliding valve can correspond, for example, to an opening size of approximately 0.01 inches to approximately 0.5 inches, including all values and sub-ranges therebetween, for a sliding valve having a diameter of approximately 0.1 inches to approximately 4 inches, including all values and sub-ranges therebetween.

The solenoid valve 30 can be activated and/or timed by the electronic control module 40 to activate the double acting piston 12, which can open and/or closed, thereby controlling the sliding valve 1.

Because the sliding valve 1 can be integrally connected to the double acting piston 12 (which can be responsive to low pressure gas that can be directed to the respective front and rear chamber by the solenoid valve 30), the double acting piston can absorb and/or resist the force of the high pressure gas in the breech when the sliding valve is open so that the closing force from the double acting piston has only to provide enough force to close against the pressure on the thin annular ring of the face of the sliding valve. This can reduce the force required to close the high pressure gas against the narrow annular surface of the sliding valve by over approximately 30% to 95%, including all values and sub-ranges therebetween. To assist in sufficiently rapid closing of the sliding valve, particularly in certain user selections for lower than usual energy and/or exit speeds, the electronic control module 40 can begin the closing sequence earlier than otherwise and/or before the opening sequence has been fully completed.

When a change in passage of low pressure gas through the solenoid valve 30 is required and/or requested, the low pressure gas from the respective chamber of the double acting piston can be released by the quick exhaust valve 31, which can allow the low pressure gas to move the double acting piston accordingly.

With a dual solenoid valve configuration utilizing two positions, and each valve having three ports, one solenoid can control the low pressure gas to the rear chamber, and the other solenoid valve can control the low pressure gas to the front chamber. The sequencing of events can be the same as with a single solenoid valve system except that the timing of the pressurization and of the de-pressurization of each chamber can be controlled independently to allow variable overlap. In certain situations, such as with certain combinations of user selection, projectile type, caliber, and/or weight, and/or the available pressure of the high pressure gas, overlap of the independent action of the double-acting piston with regard to pressurization and depressurization sequences can be provided to allow better control of a broader range of available user selection and power level. For example, the front chamber of the double acting piston can be vented prior to the full duration of the open status of the sliding valve 1.

After the trigger is released, the firing sequence can end and/or the system can return to an idle state.

To start the sequence again, a projectile can be loaded into the breech 8, and/or the trigger can be pulled. If the mode selector switch is left at the same setting for the second shot, the available high pressure gas in the tank 19 can be lower, and/or the calculation in the electronic control module 40 can yield a longer open time to achieve the same projectile energy level. This ability to maintain consistent power levels despite diminishing available high pressure gas can allow certain exemplary embodiments to provide more consistent firing.

Over time, the available pressure of the high pressure gas can become insufficient to deliver the energy level selected by the user. In these situations, the electronic control module 40 can display a different pattern of indicators and/or LED lights, which can alert the user to the fact that the desired energy level cannot be achieved. If the user continues the firing sequence, the electronic control module 40 can fire the projectile at the highest available energy without wastefully delivering excess air out of the end of the barrel muzzle after the projectile has exited. For example, the energy level can be as low as approximately 10 foot pounds to approximately 150 foot pounds for a light weight bullet, such as a 26 grain .25 caliber bullet in a short barrel, and/or as high as approximately 300 foot pounds to approximately 3,000 foot pounds, for a heavier weight bullet, such as a 500 grain .50 caliber bullet in a long barrel.

Certain exemplary embodiments can provide for the repeated delivery of available high pressure gas at a specified and/or preset energy level as the pressure of the available high pressure gas changes. That is, because the volume of the high pressure tank 19 can be fixed and/or the pressure of the available high pressure gas can diminish with each firing and/or can be monitored by the sensor 22, the control of the solenoid valve 30 by the electronic control module 40 can provide a consistent and/or predictable firing event.

The timing of the opening and/or closing of the solenoid valves and/or exhaust valves can be infinitely varied to achieve the desired results in a firing event. During the firing sequence, both valves can be actuated at the same time, or at staggered times. Similarly, for the closing sequence, both exhaust values can be actuated in unison, or can be actuated independently. If a very short open time is desired and/or available by module calculation, the rear acting valve can be de-energized before the front valve is de-energized. This action can prevent the sliding valve 1 from fully opening, and/or provide a shorter burst of high pressure gas. The electronic control module 40 can provide for the independent control of the solenoid valve 30 such that pressurizing and/or venting of each of the front chamber 13 and the rear chamber 14 can be independently controlled, which can provide a greater resolution of control of the sliding valve 1 and/or control of the firing of the gun.

Figure 13:
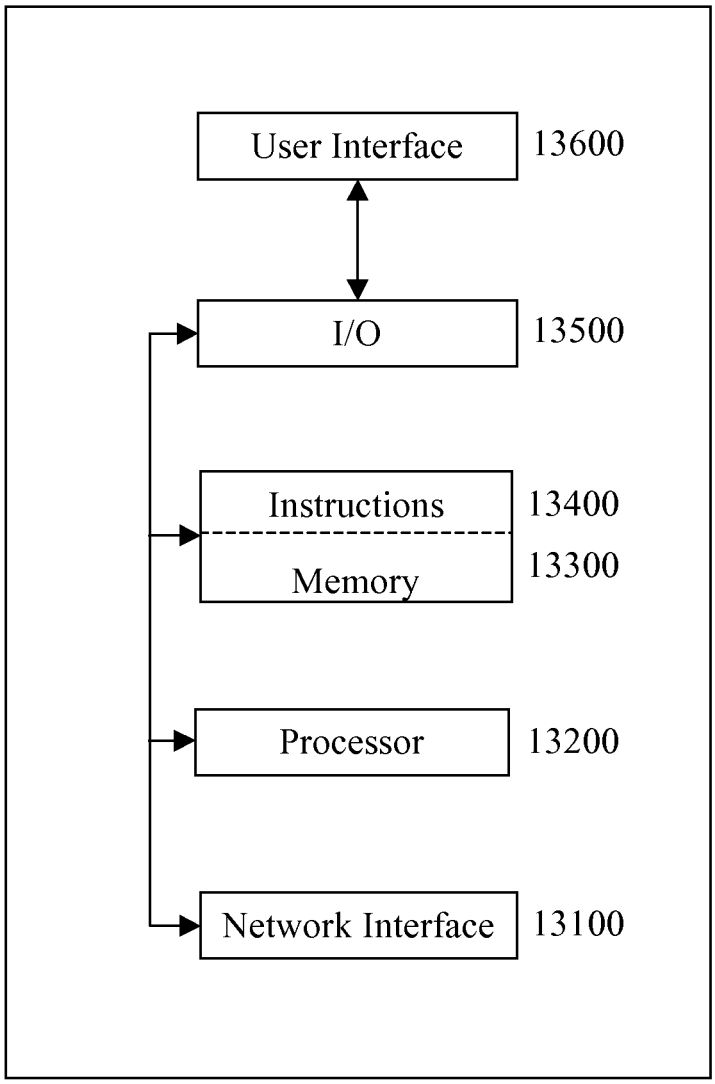
FIG. 13 a block diagram of an exemplary embodiment of an information device.

FIG. 13 is a block diagram of an exemplary embodiment of an information device 13000, which in certain operative embodiments can comprise and/or be comprised by, for example, the gun of FIG. 1 and/or electronic control module 40, etc. Information device 13000 can comprise any of numerous transform circuits, which can be formed via any of numerous communicatively-, electrically-, magnetically-, optically-, fluidically-, and/or mechanically-coupled physical components, such as for example, one or more network interfaces 13100, one or more processors 13200, one or more memories 13300 containing instructions 13400, one or more input/output (I/O) devices 13500, and/or one or more user interfaces 13600 coupled to I/O device 13500, etc.

In certain exemplary embodiments, via one or more user interfaces 13600, such as a graphical user interface, a user can view a rendering of information related to researching, designing, modeling, creating, developing, building, manufacturing, operating, maintaining, storing, marketing, selling, delivering, selecting, specifying, requesting, ordering, receiving, returning, rating, and/or recommending any of the products, services, methods, user interfaces, and/or information described herein.

Certain exemplary embodiments can provide a gun comprising:

an assembly comprising:

a tubular valve, the tubular valve moveable between a closed position and an open firing position, the open firing position adapted to cause a motive gas to expel a projectile from the gun, the tubular valve defining an interior cavity portion; and a fixed core adapted to substantially fill the interior cavity portion when said tubular valve is in the open firing position;

a movable double acting piston connected to the tubular valve and adapted to move between an open piston position and a closed piston position as directed by a control gas provided by a solenoid controlled by a controller;

a solenoid valve adapted to control a flow of a control gas provided to a piston that is adapted to open and close the tubular valve;

a first solenoid valve adapted to control a flow of a control gas provided to a piston to open the tubular valve;

a second solenoid valve adapted to control a flow of a control gas provided to a piston to close the tubular valve;

the first solenoid valve timed independently from the second solenoid valve;

a controller adapted to transmit a request for a timed burst of the motive gas, the request based on at least an available pressure of the motive gas and a weight of the projectile;

a controller adapted to transmit a request for a timed burst of the motive gas, the request based on at least an available pressure of the motive gas and a weight of the projectile;

a controller adapted to transmit a plurality of requests for a timed burst of the motive gas, each burst adapted to fire each of a plurality of projectiles at a substantially constant muzzle velocity throughout a range of reservoir gas pressures of from approximately 300 psi to approximately 3,500 psi, and throughout a range of projectile weights of from approximately 10 grains to approximately 700 grains;

a controller adapted to transmit a plurality of requests for a timed burst of the motive gas, each burst of gas adapted to fire one of a plurality of projectiles, all of the plurality of projectiles, upon exiting a muzzle of the gun, having a user-selected and substantially constant kinetic energy or a user-selected and substantially constant velocity, each burst corresponding to a different reservoir gas pressure;

an energy indicator adapted to indicate a non-zero kinetic energy of the projectile;

a velocity selector adapted to allow a user of the gun to input a user-selected non-zero velocity for the projectile;

a kinetic energy selector adapted to allow a user of the gun to input a user-selected non-zero kinetic energy for the projectile;

a user interface adapted to indicate at least one of a number of remaining firings, a pressure of the motive gas, and a position of a safety;

a controller adapted to transmit a request for a timed burst of gas adapted to fire a projectile, the request based on at least an available motive gas pressure, a weight of the projectile, and a predetermined kinetic energy for the projectile upon firing or a predetermined velocity for the projectile upon firing;

a gas-actuated sliding valve assembly adapted to, upon closing, halt, within approximately 2 milliseconds, a flow of gas having a static pressure of approximately 3500 psi or more;

a gas-actuated sliding valve assembly adapted to, upon opening, pneumatically deliver, within approximately 10 milliseconds, up to 2,500 foot pounds of energy to a projectile;

a controller adapted to transmit a request for a timed burst of gas adapted to fire each of a plurality of projectiles at a user-selected and substantially constant kinetic energy over a range of reservoir gas pressures and over a range of projectile weights; and/or a controller adapted to transmit a plurality of requests for a timed burst of gas, each burst of gas adapted to fire one of a plurality of projectiles, all of the plurality of projectiles, upon exiting a muzzle of the gun, having a user-selected and substantially constant kinetic energy or a user-selected and substantially constant velocity, each burst corresponding to a different reservoir gas pressure; and/or wherein:

the assembly is adapted to prevent the motive gas from flowing through the fixed core or through the interior cavity portion;

the assembly is adapted to, in the closed position and within approximately 2 milliseconds, substantially halt flow of the motive gas, the motive gas having a static pressure of approximately 3500 psi or more; and/or the assembly is adapted to, in the open firing position and within approximately 10 milliseconds, pneumatically deliver up to approximately 2,500 foot pounds of energy to the projectile.

Certain exemplary embodiments can provide a method comprising:

responsive to a user-initiated trigger event, selectively moving a tubular valve from a closed position to an open firing position, the open firing position adapted to cause a motive gas to expel a projectile from the gun, the tubular valve defining an interior cavity portion, a fixed core adapted to substantially fill the interior cavity portion when said tubular valve is in the open firing position, the fixed core adapted to prevent the motive gas from flowing therethrough, the tubular valve adapted to prevent the motive gas from flowing through the interior cavity portion;

transmitting, from a predetermined gun controller, a request for a timed burst of gas adapted to fire a projectile, the request based on at least an available motive gas pressure, a weight of the projectile, and a predetermined non-zero kinetic energy for the projectile or a predetermined non-zero velocity for the projectile; and/or transmitting, from a gun controller, a plurality of requests for a timed burst of gas, each burst of gas adapted to fire one of a plurality of projectiles, all of the plurality of projectiles, upon exiting a muzzle of the gun, having a user-selected and substantially constant kinetic energy or a user-selected and substantially constant velocity, each burst corresponding to a different reservoir gas pressure.

Certain exemplary embodiments can provide a machine-readable medium storing machine-implementable instructions for activities comprising:

transmitting, from a predetermined gun controller, a request for a timed burst of gas adapted to fire a projectile, the request based on at least an available motive gas pressure, a weight of the projectile, and a predetermined non-zero kinetic energy for the projectile or a predetermined non-zero velocity for the projectile.

Certain exemplary embodiments can provide a circuit comprising:

a first sub-circuit adapted to transmit, from a predetermined gun controller, a request for a timed burst of gas adapted to fire a projectile, the request based on at least an available motive gas pressure, a weight of the projectile, and a predetermined non-zero kinetic energy for the projectile or a predetermined non-zero velocity for the projectile.

Certain exemplary embodiments can provide a gun for firing a projectile with a release of compressed motive gas, the gun comprising:

a source of motive gas;

a breech retaining the projectile to be fired;

a regulator fluidly connected to the source of the motive gas to produce a volume of control gas at a pressure lower than the motive gas;

a solenoid valve fluidly connected to the regulator to receive the volume of control gas, the solenoid valve moveable between a firing configuration and a safety configuration;

a piston fluidly connected to the solenoid, the piston moveable between a first position and a second position in response to the control gas passing from the solenoid valve;

a sliding valve connected to the piston, the sliding valve moveable between a closed position and an open firing position passing motive gas from the source to the breech;

an electronic control module connected to the solenoid valve and causing the solenoid valve to move between the firing configuration and the safety configuration;

a pressure sensor fluidly connected to the source of high pressure gas;

a central core, wherein the sliding valve is tubular and sized to slideable receive a length of the central core in a sealed relation;

a front chamber and a rear chamber fluidly connected to a corresponding first surface of piston and a second surface of the piston, the solenoid valve fluidly connected to the front chamber and the rear chamber;

a user interface indicating at least one of a number of remaining firings, a pressure of the motive gas and a position of a safety; and/or wherein:

the source of high pressure motive gas is a high pressure tank;

the double acting piston is integral with sliding valve;

the double acting piston is separable from sliding valve;

the motive gas has a pressure of at least 3,000 pounds per square inch;

the control gas has a pressure less than 850 pounds per square inch;

the sliding valve is tubular and includes an annular seal surface to preclude passage of motive gas to the breech;

the sliding valve is sealed with respect to the piston; and/or the solenoid valve includes first valve and an independent second valve.

Certain exemplary embodiments can provide a method of firing a projectile from a breech of a gun, the method comprising:

urging a sliding valve to a closed position precluding passage of a motive gas from a source of the motive gas to the breech;

monitoring a pressure of the source of motive gas;

regulating a volume of the motive gas to a lower pressure control gas;

selectively passing the control gas to a piston to move the sliding valve from the closed position toward a fully open position;

selectively passing the control gas to the piston to move the sliding valve from an open position to the closed position;

selectively passing the control gas to the piston to move the sliding valve from the open position to the closed position prior to the sliding valve moving to the fully open position; and/or employing a solenoid valve and an electronic control module on the gun to control passing the control gas to the piston; and/or wherein:

the control gas has a pressure less than 850 pounds per square inch.

Certain exemplary embodiments can provide an air weapon comprising:

a tubular valve comprising a means to deliver high pressure air (HPA) to fire a projectile out of a barrel;

a means that can slide open said tubular valve to admit HPA to fire a projectile and to slide and seal gas tight when said tubular valve is closed after firing said projectile;

a rigid gas tight fixed center core inside said tubular valve;

a rigid gas tight bushing outside of said tubular valve;

support for said tubular valve to slide open and to slide closed;

a movable double acting piston that comprises said tubular valve the means to slide open and to slide closed;

a movable double acting piston be actuated to slide open and to slide closed as directed by low pressure air (LPA) provided precisely by solenoid valve means being timed precisely by microprocessor module means;

a means for said tubular valve to slide open rapidly for a timed burst of HPA when firing a projectile out of the barrel;

an air pressure means directing LPA to the front chamber of said double acting piston for said actuation means that slides open said tubular valve for said timed burst of HPA to fire a projectile out of the barrel;

air pressure means directing LPA to the rear chamber of said double acting piston for said actuation means that slides closed said tubular valve to be sealed gas tight after the firing of a projectile;

air pressure means comprising one or more independently timed solenoid valve means that comprise control of said directed air pressure to slide open and to slide closed said tubular valve; and/or independently timed solenoid valve means comprise said LPA means comprising solenoid means that are singly functioning, and in combinations functioning, and in combined single solenoid multiply functioning; and/or where:

said tubular valve comprises connected means to its single double acting piston that actuates its means to slide closed gas tight against a face seal until a firing sequence is initiated.

Certain exemplary embodiments can provide a means of operation of an air weapon comprising:

a means to admit a high pressure burst of air to fire a projectile out of a barrel;

an electronic microprocessor module comprising a means to time precisely said burst of high pressure air (HPA) that comprises the means to fire a projectile out of the barrel;

an electric and manual timed means that comprise a means to fire a projectile out of the barrel;

a minimal frontal area to said HPA that comprises the movable portion of said tubular valve reducing the energy required to operate said air weapon;

a connected means to be attached to a single double acting valve responsive to LPA force by directed means to each side chamber as needed to slide open and to slide closed the tubular valve;

a gas tight sealed means against said HPA in the operation of and the firing of said air weapon.

Certain exemplary embodiments can provide a an electronic module comprising:

a microprocessor means comprising electronic circuit board means to control, to time precisely, to operate, and to fire said air weapon;

timed means of one or more independently timed solenoid valves comprising an LPA means of operating said tubular valve comprising connection to said single double acting piston responsive to directed LPA force to slide open and to slide closed said tubular valve;

a means of rapid directional changing comprising LPA for sliding open and sliding closed said connected single double acting piston;

a means to time precisely by said microprocessor module means the operating of said tubular valve comprising rapid opening to provide a consistent burst of HPA to fire a projectile out of the barrel;

a means of being independently controlled by solenoid means comprising LPA to operate each side chamber of said connected single double acting piston to control said tubular valve to slide open and to slide closed;

a means of operating said air weapon by the means of an air pressure regulator comprising LPA means and reservoir storage of said LPA wherein said solenoid means provide said LPA to operate each side chamber of said single double acting piston to slide open and to slide closed;

a transducer sensor means that provides the user interface means the data comprising available HPA energy level for firing a projectile out of the barrel;

a means of producing the maximum number of firings of said projectile comprising selectable power level as determined by user interface means;

a means for said power level comprise selectable and adjustable means by said user interface means;

a means for removal and replacement of said module for service and upgrade as needed in said air weapon;

a means to receive its operable energy from batteries and battery pack that are rechargeable and replaceable as needed;

a means to indicate remaining battery energy power level to user interface means;

a means to receive input data from a trigger module micro switch means to initiate the firing event of said air weapon; and/or a means to indicate HPA energy power level available by transducer sensor means to achieve a desired exit speed in a firing event of a projectile out of the barrel.

DEFINITIONS

When the following phrases are used substantively herein, the accompanying definitions apply. These phrases and definitions are presented without prejudice, and, consistent with the application, the right to redefine these phrases via amendment during the prosecution of this application or any application claiming priority hereto is reserved. For the purpose of interpreting a claim of any patent that claims priority hereto, each definition in that patent functions as a clear and unambiguous disavowal of the subject matter outside of that definition.

a—at least one.

activity—an action, act, step, and/or process or portion thereof.

adapted—suitable, fit, and/or capable of performing a specified function.

allow—to provide, let do, happen, and/or permit.

an—at least one.

and—in conjunction with.

and/or—either in conjunction with or in alternative to.

annular—shaped like a ring.

apparatus—an appliance or device for a particular purpose.

assembly—a group of parts.

at—in, on, and/or near.

at least—not less than, and possibly more than.

automatic—performed via an information device in a manner essentially independent of influence and/or control by a user. For example, an automatic light switch can turn on upon "seeing" a person in its "view", without the person manually operating the light switch.

available—present and/or ready for use.

based—being derived from, conditional upon, and/or dependent upon.

be—to exist in actuality.

between—in a separating interval and/or intermediate to.

Boolean logic—a complete system for logical operations.

breech—a rearward portion of a barrel of a gun.

burst—a sudden flow of a gas.

by—via and/or with the use or help of.

can—is capable of, in at least some embodiments.

cause—to bring about, provoke, precipitate, produce, elicit, be the reason for, result in, and/or effect.

cavity—a hollow area within an object.

central—situated at, in, or near the center of a length.

chamber—a space and/or compartment that is at least partially defined and surrounded by one or more objects.

circuit—a physical system comprising, depending on context: an electrically conductive pathway, an information transmission mechanism, and/or a communications connection, the pathway, mechanism, and/or connection established via a switching device (such as a switch, relay, transistor, and/or logic gate, etc.); and/or an electrically conductive pathway, an information transmission mechanism, and/or a communications connection, the pathway, mechanism, and/or connection established across two or more switching devices comprised by a network and between corresponding end systems connected to, but not comprised by the network.

close—to move (a door, for example) so that an opening or passage is covered and/or obstructed; to shut; and/or to draw and/or bind together.

closed—the result of closing, having boundaries, and/or enclosed.

comprising—including but not limited to, what follows.

configuration—a physical, logical, and/or logistical arrangement of elements.

connected—physically and/or logically linked.

constant—continually occurring; persistent; unchanging; and/or substantially invariant over time.

containing—including but not limited to.

control—(n) a mechanical or electronic device used to operate a machine within predetermined limits; (v) to exercise authoritative and/or dominating influence over, cause to act in a predetermined manner, direct, adjust to a requirement, and/or regulate.

controller—a device and/or set of machine-readable instructions for performing one or more predetermined and/or user-defined tasks. A controller can comprise any one or a combination of hardware, firmware, and/or software. A controller can utilize mechanical, pneumatic, hydraulic, electrical, magnetic, optical, informational, chemical, and/or biological principles, signals, and/or inputs to perform the task(s). In certain embodiments, a controller can act upon information by manipulating, analyzing, modifying, converting, transmitting the information for use by an executable procedure and/or an information device, and/or routing the information to an output device. A controller can be a central processing unit, a local controller, a remote controller, parallel controllers, and/or distributed controllers, etc. The controller can be a general-purpose microcontroller, such the Pentium IV series of microprocessor manufactured by the Intel Corporation of Santa Clara, Calif., and/or the HC08 series from Motorola of Schaumburg, Ill. In another embodiment, the controller can be an Application Specific Integrated Circuit (ASIC) or a Field Programmable Gate Array (FPGA) that has been designed to implement in its hardware and/or firmware at least a part of an embodiment disclosed herein.

core—a substantially innermost and/or central, and potentially removable, object.

correspond—to fit, meet, resemble, harmonize, match, be similar to and/or be equivalent in character, quantity, origin, structure, and/or function; to accompany, be related to, and/or be associated with.

data—distinct pieces of information, usually formatted in a special or predetermined way and/or organized to express concepts, and/or represented in a form suitable for processing by an information device.

data structure—an organization of a collection of data that allows the data to be manipulated effectively and/or a logical relationship among data elements that is designed to support specific data manipulation functions. A data structure can comprise meta data to describe the properties of the data structure. Examples of data structures can include: array, dictionary, graph, hash, heap, linked list, matrix, object, queue, ring, stack, tree, and/or vector.

define—to establish the meaning, relationship, outline, form, and/or structure of and/or to precisely and/or distinctly describe and/or specify.

deliver—to provide, present, give forth, impose, and/or emit.

device—a machine, manufacture, and/or collection thereof.

different—changed, distinct, and/or separate.

digital—non-analog and/or discrete.

direct—to control and/or cause.

double-acting—adapted to move in opposite directions along a longitudinal axis.

each—every one of a group considered individually.

electronic—digitally processed, stored, and/or transmitted.

event—an occurrence and/or happening.

exit—(n) an act of going away or out and/or a passage or way out; (v) to depart, go out of, and/or leave.

expel—to force, drive out, and/or discharge from.

fill—to plug, block, pervade, and/or occupy the whole of fire—(v.) to discharge a gun in a manner that could propel a projectile out of the gun's barrel.

firing—(n) a discharge of a gun.

first—an initial entity in an ordering of entities; immediately preceding the second in an ordering.

fixed—secured and/or incapable of translating with respect to a related object.

flow—(n) a stream and/or current; (v) to move and/or run smoothly with unbroken continuity, as in the manner characteristic of a fluid.

fluid—a liquid, slurry, vapor, gas, mist, cloud, plume, and/or foam, etc.

foot pound—a unit of energy and/or work, being equal to the work done in raising one pound avoirdupois against the force of gravity through a vertical distance of one foot.

from—used to indicate a source and/or a location of origin.

fully open position—a location at which a device can not open any further.

further—in addition.

gas—a state of matter distinguished from the solid and liquid states by relatively low density and viscosity, relatively great expansion and contraction with changes in pressure and temperature, the ability to diffuse readily, and/or the spontaneous tendency to become distributed uniformly throughout any container; and/or a substance in a gaseous state.

gun—a device resembling a firearm and/or cannon, the device adapted to, without utilizing the combustion of gunpowder, an explosive, or the like, project something, such as air, soap, water, and/or a solid object, under pressure and/or at a relatively rapid velocity.

halt—to stop and/or fully impede motion in a predetermined and/or principle direction.

haptic—involving the human sense of kinesthetic movement and/or the human sense of touch. Among the many potential haptic experiences are numerous sensations, body-positional differences in sensations, and time-based changes in sensations that are perceived at least partially in non-visual, non-audible, and non-olfactory manners, including the experiences of tactile touch (being touched), active touch, grasping, pressure, friction, traction, slip, stretch, force, torque, impact, puncture, vibration, motion, acceleration, jerk, pulse, orientation, limb position, gravity, texture, gap, recess, viscosity, pain, itch, moisture, temperature, thermal conductivity, and thermal capacity.

having—including but not limited to.

human-machine interface—hardware and/or software adapted to render information to a user and/or receive information from the user; and/or a user interface.

inch—a unit of linear measurement in the English system equal to approximately 2.54 cm.

include—to comprise.

independent—without dependence upon and/or regard for another.

indicate—to show, mark, signal, signify, denote, evidence, evince, manifest, declare, enunciate, specify, explain, exhibit, present, reveal, disclose, and/or display.

indicator—a device and/or feature adapted to serve as a measure, sign, and/or signal.

information device—any device capable of processing data and/or information, such as any general purpose and/or special purpose computer, such as a personal computer, workstation, server, minicomputer, mainframe, supercomputer, computer terminal, laptop, wearable computer, and/or Personal Digital Assistant (PDA), mobile terminal, Bluetooth device, communicator, "smart" phone (such as an iPhone-like and/or Treo-like device), messaging service (e.g., Blackberry) receiver, pager, facsimile, cellular telephone, a traditional telephone, telephonic device, a programmed microprocessor or microcontroller and/or peripheral integrated circuit elements, an ASIC or other integrated circuit, a hardware electronic logic circuit such as a discrete element circuit, and/or a programmable logic device such as a PLD, PLA, FPGA, or PAL, or the like, etc. In general any device on which resides a finite state machine capable of implementing at least a portion of a method, structure, and/or or graphical user interface described herein may be used as an information device. An information device can comprise components such as one or more network interfaces, one or more processors, one or more memories containing instructions, and/or one or more input/output (I/O) devices, one or more user interfaces coupled to an I/O device, etc.

input—(n) a signal, data, and/or information provided to a processor, device, and/or system; (v) to enter (data and/or a program) into an information device, computer, and/or machine.

input/output (I/O) device—any device adapted to provide input to, and/or receive output from, an information device. Examples can include an audio, visual, haptic, olfactory, and/or taste-oriented device, including, for example, a monitor, display, projector, overhead display, keyboard, keypad, mouse, trackball, joystick, gamepad, wheel, touchpad, touch panel, pointing device, microphone, speaker, video camera, camera, scanner, printer, switch, relay, haptic device, vibrator, tactile simulator, and/or tactile pad, potentially including a port to which an I/O device can be attached or connected.

instructions—directions, which can be implemented as hardware, firmware, and/or software, the directions adapted to perform a particular operation and/or function via creation and/or maintenance of a predetermined physical circuit.

integral—formed or united into another entity.

interior—being within; inside of anything; internal; inner; further toward a center.

kinetic energy—the energy possessed by a body because of its motion, equal to one half the mass of the body times the square of its speed.

length—a longest dimension of something and/or the measurement of the extent of something along its greatest dimension.

less than—having a measurably smaller magnitude and/or degree as compared to something else.

load—(v) to insert into a device, such as to insert a round into a gun.

logic gate—a physical device adapted to perform a logical operation on one or more logic inputs and to produce a single logic output, which is manifested physically. Because the output is also a logic-level value, an output of one logic gate can connect to the input of one or more other logic gates, and via such combinations, complex operations can be performed. The logic normally performed is Boolean logic and is most commonly found in digital circuits. The most common implementations of logic gates are based on electronics using resistors, transistors, and/or diodes, and such implementations often appear in large arrays in the form of integrated circuits (a.k.a., IC's, microcircuits, microchips, silicon chips, and/or chips). It is possible, however, to create logic gates that operate based on vacuum tubes, electromagnetics (e.g., relays), mechanics (e.g., gears), fluidics, optics, chemical reactions, and/or DNA, including on a molecular scale. Each electronically-implemented logic gate typically has two inputs and one output, each having a logic level or state typically physically represented by a voltage. At any given moment, every terminal is in one of the two binary logic states ("false" (a.k.a., "low" or "0") or "true" (a.k.a., "high" or "1"), represented by different voltage levels, yet the logic state of a terminal can, and generally does, change often, as the circuit processes data. Thus, each electronic logic gate typically requires power so that it can source and/or sink currents to achieve the correct output voltage. Typically, machine-implementable instructions are ultimately encoded into binary values of "0"s and/or "1"s and, are typically written into and/or onto a memory device, such as a "register", which records the binary value as a change in a physical property of the memory device, such as a change in voltage, current, charge, phase, pressure, weight, height, tension, level, gap, position, velocity, momentum, force, temperature, polarity, magnetic field, magnetic force, magnetic orientation, reflectivity, molecular linkage, molecular weight, etc. An exemplary register might store a value of "01101100", which encodes a total of 8 "bits" (one byte), where each value of either "0" or "1" is called a "bit" (and 8 bits are collectively called a "byte"). Note that because a binary bit can only have one of two different values (either "0" or "1"), any physical medium capable of switching between two saturated states can be used to represent a bit. Therefore, any physical system capable of representing binary bits is able to represent numerical quantities, and potentially can manipulate those numbers via particular encoded machine-implementable instructions. This is one of the basic concepts underlying digital computing. At the register and/or gate level, a computer does not treat these "0"s and "1"s as numbers per se, but typically as voltage levels (in the case of an electronically-implemented computer), for example, a high voltage of approximately +3 volts might represent a "1" or "logical true" and a low voltage of approximately 0 volts might represent a "0" or "logical false" (or vice versa, depending on how the circuitry is designed). These high and low voltages (or other physical properties, depending on the nature of the implementation) are typically fed into a series of logic gates, which in turn, through the correct logic design, produce the physical and logical results specified by the particular encoded machine-implementable instructions. For example, if the encoding request a calculation, the logic gates might add the first two bits of the encoding together, produce a result "1" ("0"+"1"="1"), and then write this result into another register for subsequent retrieval and reading. Or, if the encoding is a request for some kind of service, the logic gates might in turn access or write into some other registers which would in turn trigger other logic gates to initiate the requested service.

logical—a conceptual representation.

lower—lesser in magnitude in relation to something else.

machine-implementable instructions—directions adapted to cause a machine, such as an information device, to perform one or more particular activities, operations, and/or functions via forming a particular physical circuit. The directions, which can sometimes form an entity called a "processor", "kernel", "operating system", "program", "application", "utility", "subroutine", "script", "macro", "file", "project", "module", "library", "class", and/or "object", etc., can be embodied and/or encoded as machine code, source code, object code, compiled code, assembled code, interpretable code, and/or executable code, etc., in hardware, firmware, and/or software.

machine-readable medium—a physical structure from which a machine, such as an information device, computer, microprocessor, and/or controller, etc., can store and/or obtain one or more machine-implementable instructions, data, and/or information. Examples include a memory device, punch card, player-plano scroll, etc.

may—is allowed and/or permitted to, in at least some embodiments.

memory device—an apparatus capable of storing, sometimes permanently, machine-implementable instructions, data, and/or information, in analog and/or digital format. Examples include at least one non-volatile memory, volatile memory, register, relay, switch, Random Access Memory, RAM, Read Only Memory, ROM, flash memory, magnetic media, hard disk, floppy disk, magnetic tape, optical media, optical disk, compact disk, CD, digital versatile disk, DVD, and/or raid array, etc. The memory device can be coupled to a processor and/or can store and provide instructions adapted to be executed by processor, such as according to an embodiment disclosed herein.

method—one or more acts that are performed upon subject matter to be transformed to a different state or thing and/or are tied to a particular apparatus, said one or more acts not a fundamental principal and not pre-empting all uses of a fundamental principal.

millisecond—0.001 seconds.

module—a device adapted to be communicatively coupled to a predetermined set of information devices, input/output devices, sensors, and/or actuators.

monitor—to observe and/or to systematically check, test, and/or sample for the purpose of evaluating a statistic of a metric related to the performance of a system, network, routing entity, source, destination, etc.

more—a quantifier meaning greater in size or amount or extent or degree.

motive—causing or able to cause motion.

move—to change a position and/or place.

moveable—capable of being non-destructively moved.

muzzle—the forward, discharging end of the barrel of a gun.

network—a communicatively coupled plurality of nodes, communication devices, and/or information devices. Via a network, such nodes and/or devices can be linked, such as via various wireline and/or wireless media, such as cables, telephone lines, power lines, optical fibers, radio waves, and/or light beams, etc., to share resources (such as printers and/or memory devices), exchange files, and/or allow electronic communications therebetween. A network can be and/or can utilize any of a wide variety of sub-networks and/or protocols, such as a circuit switched, public-switched, packet switched, connection-less, wireless, virtual, radio, data, telephone, twisted pair, POTS, non-POTS, DSL, cellular, telecommunications, video distribution, cable, radio, terrestrial, microwave, broadcast, satellite, broadband, corporate, global, national, regional, wide area, backbone, packet-switched TCP/IP, IEEE 802.03, Ethernet, Fast Ethernet, Token Ring, local area, wide area, IP, public Internet, intranet, private, ATM, Ultra Wide Band (UWB), Wi-Fi, BlueTooth, Airport, IEEE 802.11, IEEE 802.11a, IEEE 802.11b, IEEE 802.11g, X-10, electrical power, 3G, 4G, multi-domain, and/or multi-zone sub-network and/or protocol, one or more Internet service providers, one or more network interfaces, and/or one or more information devices, such as a switch, router, and/or gateway not directly connected to a local area network, etc., and/or any equivalents thereof.

network interface—any physical and/or logical device, system, and/or process capable of coupling an information device to a network. Exemplary network interfaces comprise a telephone, cellular phone, cellular modem, telephone data modem, fax modem, wireless transceiver, communications port, ethernet card, cable modem, digital subscriber line interface, bridge, hub, router, or other similar device, software to manage such a device, and/or software to provide a function of such a device.

non-zero—a value other than zero.

number—a count and/or quantity.

one—being or amounting to a single unit or individual or entire thing, item, and/or object.

open—(v) to interrupt, to release from a closed and/or fastened position, to remove obstructions from, to clear, and/or to electrically decouple in a manner to create a gap across which electrical energy cannot readily flow; (adj) not substantially obstructed and/or not closed.

operate—to perform a function and/or to work.

packet—a generic term for a bundle of data organized in a specific way for transmission, such as within and/or across a network, such as a digital packet-switching network, and comprising the data to be transmitted and certain control information, such as a destination address.

pass—to convey, transfer, and/or transmit and/or to move through, beyond, and/or with respect to, without local change of direction.

passage—a path, channel, and/or duct through, over, and/or along which something may pass; a motion of a first object relative to a second object; and/or a transfer, conveyance, and/or transmission.

perceptible—capable of being perceived by the human senses.

physical—tangible, real, and/or actual.

physically—existing, happening, occurring, acting, and/or operating in a manner that is tangible, real, and/or actual.

piston—a sliding piece which either is moved by, or moves against, fluid pressure.

plurality—the state of being plural and/or more than one.

pneumatic—of or relating to air or other gases.

portion—a part, component, section, percentage, ratio, and/or quantity that is less than a larger whole. Can be visually, physically, and/or virtually distinguishable and/or non-distinguishable.

position—(n) a place and/or location, often relative to a reference point. (v) to place and/or locate.

preclude—to resist and/or prevent.

predetermined—established in advance.

pressure—a measure of force applied uniformly over a surface.

prevent—to impede, resist, hinder, stop, and/or keep from happening.

prior—preceding in time or order.

probability—a quantitative representation of a likelihood of an occurrence.

processor—a machine that utilizes hardware, firmware, and/or software and is physically adaptable to perform, via Boolean logic operating on a plurality of logic gates that form particular physical circuits, a specific task defined by a set of machine-implementable instructions. A processor can utilize mechanical, pneumatic, hydraulic, electrical, magnetic, optical, informational, chemical, and/or biological principles, mechanisms, adaptations, signals, inputs, and/or outputs to perform the task(s). In certain embodiments, a processor can act upon information by manipulating, analyzing, modifying, and/or converting it, transmitting the information for use by machine-implementable instructions and/or an information device, and/or routing the information to an output device. A processor can function as a central processing unit, local controller, remote controller, parallel controller, and/or distributed controller, etc. Unless stated otherwise, the processor can be a general-purpose device, such as a microcontroller and/or a microprocessor, such the Pentium family of microprocessor manufactured by the Intel Corporation of Santa Clara, Calif. In certain embodiments, the processor can be dedicated purpose device, such as an Application Specific Integrated Circuit (ASIC) or a Field Programmable Gate Array (FPGA) that has been designed to implement in its hardware and/or firmware at least a part of an embodiment disclosed herein. A processor can reside on and use the capabilities of a controller.

produce—to generate via a physical effort, manufacture, and/or make.

projectile—an object propelled through space by the exertion of a force, which ceases after launch.

range—a defined interval characterized by a predetermined maximum value and/or a predetermined minimum value.

receive—to gather, take, acquire, obtain, accept, get, and/or have bestowed upon.

regulator—a device adapted to control, direct, and/or adjust a property, such as the flow of a gas or an electric current.

relation—association and/or correlation.

remaining—not activated in a present cycle.

render—to, e.g., physically, chemically, biologically, electronically, electrically, magnetically, optically, acoustically, fluidically, and/or mechanically, etc., transform information into a form perceptible to a human as, for example, data, commands, text, graphics, audio, video, animation, and/or hyperlinks, etc., such as via a visual, audio, and/or haptic, etc., means and/or depiction, such as via a display, monitor, electric paper, ocular implant, cochlear implant, speaker, vibrator, shaker, force-feedback device, stylus, joystick, steering wheel, glove, blower, heater, cooler, pin array, tactile touchscreen, etc.

repeatedly—again and again, repetitively, and/or with consistent behavior.

request—(v.) to express a need and/or desire for; to inquire and/or ask for; (n.) that which communicates an expression of desire and/or that which is asked for; and/or a communication asking for a response and/or service.

reservoir—a receptacle or chamber for storing and/or directing movement of a fluid.

response—a reaction, reply, and/or answer to an influence and/or impetus.

responsive—reacting to an influence and/or impetus.

retain—to restrain motion of in at least one direction.

safety—a device adapted to prevent accidents, such as a lock on a gun adapted to preventing accidental firing.

seal—(v.) to shut close; to keep close; to make fast; to keep secure; to prevent leakage; (n.) a device adapted to shut close; to keep close; to make fast; to keep secure; and/or to prevent leakage.

sealed—enclosed.

second—immediately following an initial item in an ordering.

selectively—via choice.

selector—a switch that is used to select among alternatives.

sensor—a device adapted to automatically sense, perceive, detect, and/or measure a physical property (e.g., pressure, temperature, flow, mass, heat, light, sound, humidity, proximity, position, velocity, vibration, loudness, voltage, current, capacitance, resistance, inductance, magnetic flux, and/or electro-magnetic radiation, etc.) and convert that physical quantity into a signal. Examples include position sensors, proximity switches, stain gages, photo sensors, thermocouples, level indicating devices, speed sensors, accelerometers, electrical voltage indicators, electrical current indicators, on/off indicators, and/or flowmeters, etc.

separable—configured to be non-destructively set apart, disengaged, and/or disunited.

set—a related plurality.

signal—(v) to communicate; (n) one or more automatically detectable variations in a physical variable, such as a pneumatic, hydraulic, acoustic, fluidic, mechanical, electrical, magnetic, optical, chemical, and/or biological variable, such as power, energy, pressure, flowrate, viscosity, density, torque, impact, force, frequency, phase, voltage, current, resistance, magnetomotive force, magnetic field intensity, magnetic field flux, magnetic flux density, reluctance, permeability, index of refraction, optical wavelength, polarization, reflectance, transmittance, phase shift, concentration, and/or temperature, etc., that can encode information, such as machine-implementable instructions for activities and/or one or more letters, words, characters, symbols, signal flags, visual displays, and/or special sounds, etc., having prearranged meaning. Depending on the context, a signal and/or the information encoded therein can be synchronous, asynchronous, hard real-time, soft real-time, non-real time, continuously generated, continuously varying, analog, discretely generated, discretely varying, quantized, digital, broadcast, multicast, unicast, transmitted, conveyed, received, continuously measured, discretely measured, processed, encoded, encrypted, multiplexed, modulated, spread, de-spread, demodulated, detected, de-multiplexed, decrypted, and/or decoded, etc.

size—physical dimensions, proportions, magnitude, amount, and/or extent of an entity.

slide—to, in a smooth and/or continuous motion, move one object relative to another.

slideably—a smooth and/or continuous motion of one object relative to another.

solenoid—an assembly used as a switch, and comprising a coil and a metal core free to slide along the coil axis under the influence of the magnetic field. A solenoid can open and close an integral fluid valve in unison with the movement of the solenoid's metal core.

source—a point at which something originates, springs into being, and/or from which it derives and/or is obtained.

special purpose computer—a computer and/or information device comprising a processor device having a plurality of logic gates, whereby at least a portion of those logic gates, via implementation of specific machine-implementable instructions by the processor, experience a change in at least one physical and measurable property, such as a voltage, current, charge, phase, pressure, weight, height, tension, level, gap, position, velocity, momentum, force, temperature, polarity, magnetic field, magnetic force, magnetic orientation, reflectivity, molecular linkage, molecular weight, etc., thereby directly tying the specific machine-implementable instructions to the logic gate's specific configuration and property(ies). In the context of an electronic computer, each such change in the logic gates creates a specific electrical circuit, thereby directly tying the specific machine-implementable instructions to that specific electrical circuit.

special purpose processor—a processor device, having a plurality of logic gates, whereby at least a portion of those logic gates, via implementation of specific machine-implementable instructions by the processor, experience a change in at least one physical and measurable property, such as a voltage, current, charge, phase, pressure, weight, height, tension, level, gap, position, velocity, momentum, force, temperature, polarity, magnetic field, magnetic force, magnetic orientation, reflectivity, molecular linkage, molecular weight, etc., thereby directly tying the specific machine-implementable instructions to the logic gate's specific configuration and property(ies). In the context of an electronic computer, each such change in the logic gates creates a specific electrical circuit, thereby directly tying the specific machine-implementable instructions to that specific electrical circuit.

static—stationary and/or constant.

store—to place, hold, and/or retain data, typically in a memory.

sub-circuit—a that is adapted to fit and/or work with other circuits.

substantially—to a great extent and/or degree.

surface—the outer boundary of an object or a material layer constituting or resembling such a boundary.

switch—(v) to: form, open, and/or close one or more circuits; form, complete, and/or break an electrical and/or informational path; select a path and/or circuit from a plurality of available paths and/or circuits; and/or establish a connection between disparate transmission path segments in a network (or between networks); (n) a physical device, such as a mechanical, electrical, and/or electronic device, that is adapted to switch.

system—a collection of mechanisms, devices, machines, articles of manufacture, processes, data, and/or instructions, the collection designed to perform one or more specific functions.

tank—a container adapted to hold and/or store a solid and/or fluid.

therethrough—in one end and out another end of an object.

through—in one side and out the opposite or another side of, across, among, and/or between.

toward—used to indicate a destination and/or in a physical and/or logical direction of transform—to change in measurable: form, appearance, nature, and/or character.

trigger—(n) a device, such as a lever, the pulling or pressing of which causes a predetermined action to take place and/or one or more conditions that results in one or more actions; (v) to initiate.

tubular—shaped substantially like a tube and/or pipe; and/or having a hollow, substantially cylindrical shape.

upon—on occasion of, during, when, and/or while.

urge—to advocate, encourage, stimulate, excite, move, impel, force, and/or drive.

user—a person, organization, process, device, program, protocol, and/or system that uses a device, system, process, and/or service.

user interface—any device for rendering information to a user and/or requesting information from the user. A user interface includes at least one of textual, graphical, audio, video, animation, and/or haptic elements. A textual element can be provided, for example, by a printer, monitor, display, projector, etc. A graphical element can be provided, for example, via a monitor, display, projector, and/or visual indication device, such as a light, flag, beacon, etc. An audio element can be provided, for example, via a speaker, microphone, and/or other sound generating and/or receiving device. A video element or animation element can be provided, for example, via a monitor, display, projector, and/or other visual device. A haptic element can be provided, for example, via a very low frequency speaker, vibrator, tactile stimulator, tactile pad, simulator, keyboard, keypad, mouse, trackball, joystick, gamepad, wheel, touchpad, touch panel, pointing device, and/or other haptic device, etc. A user interface can include one or more textual elements such as, for example, one or more letters, number, symbols, etc. A user interface can include one or more graphical elements such as, for example, an image, photograph, drawing, icon, window, title bar, panel, sheet, tab, drawer, matrix, table, form, calendar, outline view, frame, dialog box, static text, text box, list, pick list, pop-up list, pull-down list, menu, tool bar, dock, check box, radio button, hyperlink, browser, button, control, palette, preview panel, color wheel, dial, slider, scroll bar, cursor, status bar, stepper, and/or progress indicator, etc. A textual and/or graphical element can be used for selecting, programming, adjusting, changing, specifying, etc. an appearance, background color, background style, border style, border thickness, foreground color, font, font style, font size, alignment, line spacing, indent, maximum data length, validation, query, cursor type, pointer type, autosizing, position, and/or dimension, etc. A user interface can include one or more audio elements such as, for example, a volume control, pitch control, speed control, voice selector, and/or one or more elements for controlling audio play, speed, pause, fast forward, reverse, etc. A user interface can include one or more video elements such as, for example, elements controlling video play, speed, pause, fast forward, reverse, zoom-in, zoom-out, rotate, and/or tilt, etc. A user interface can include one or more animation elements such as, for example, elements controlling animation play, pause, fast forward, reverse, zoom-in, zoom-out, rotate, tilt, color, intensity, speed, frequency, appearance, etc. A user interface can include one or more haptic elements such as, for example, elements utilizing tactile stimulus, force, pressure, vibration, motion, displacement, temperature, etc.

valve—a device that regulates flow through a pipe and/or through an aperture by opening, closing, and/or obstructing a port and/or passageway.

velocity—a translational speed.

via—by way of and/or utilizing.

volume—a mass and/or a three-dimensional region that an object and/or substance occupies.

weight—a force with which a body is attracted to Earth or another celestial body, equal to the product of the object's mass and the acceleration of gravity; and/or a factor assigned to a number in a computation, such as in determining an average, to make the number's effect on the computation reflect its importance.

when—at a time and/or during the time at which.

wherein—in regard to which; and; and/or in addition to.

with—accompanied by.

with respect to—in relation to and/or relative to.

within—inside the limits of.

Note

Various substantially and specifically practical and useful exemplary embodiments of the claimed subject matter are described herein, textually and/or graphically, including the best mode, if any, known to the inventor(s), for implementing the claimed subject matter by persons having ordinary skill in the art. Any of numerous possible variations (e.g., modifications, augmentations, embellishments, refinements, and/or enhancements, etc.), details (e.g., species, aspects, nuances, and/or elaborations, etc.), and/or equivalents (e.g., substitutions, replacements, combinations, and/or alternatives, etc.) of one or more embodiments described herein might become apparent upon reading this document to a person having ordinary skill in the art, relying upon his/her expertise and/or knowledge of the entirety of the art and without exercising undue experimentation. The inventor(s) expects skilled artisans to implement such variations, details, and/or equivalents as appropriate, and the inventor(s) therefore intends for the claimed subject matter to be practiced other than as specifically described herein. Accordingly, as permitted by law, the claimed subject matter includes and covers all variations, details, and equivalents of that claimed subject matter. Moreover, as permitted by law, every combination of the herein described characteristics, functions, activities, substances, and/or structural elements, and all possible variations, details, and equivalents thereof, is encompassed by the claimed subject matter unless otherwise clearly indicated herein, clearly and specifically disclaimed, or otherwise clearly contradicted by context.

The use of any and all examples, or exemplary language (e.g., "such as") provided herein, is intended merely to better illuminate one or more embodiments and does not pose a limitation on the scope of any claimed subject matter unless otherwise stated. No language herein should be construed as indicating any non-claimed subject matter as essential to the practice of the claimed subject matter.

Thus, regardless of the content of any portion (e.g., title, field, background, summary, description, abstract, drawing figure, etc.) of this document, unless clearly specified to the contrary, such as via explicit definition, assertion, or argument, or clearly contradicted by context, with respect to any claim, whether of this document and/or any claim of any document claiming priority hereto, and whether originally presented or otherwise:

there is no requirement for the inclusion of any particular described characteristic, function, activity, substance, or structural element, for any particular sequence of activities, for any particular combination of substances, or for any particular interrelationship of elements;

no described characteristic, function, activity, substance, or structural element is "essential";

any two or more described substances can be mixed, combined, reacted, separated, and/or segregated;

any described characteristics, functions, activities, substances, and/or structural elements can be integrated, segregated, and/or duplicated;

any described activity can be repeated, any activity can be performed by multiple entities, and/or any activity can be performed in multiple jurisdictions; and any described characteristic, function, activity, substance, and/or structural element can be specifically excluded, the sequence of activities can vary, and/or the interrelationship of structural elements can vary.

The use of the terms "a", "an", "said", "the", and/or similar referents in the context of describing various embodiments (especially in the context of the following claims) are to be construed to cover both the singular and the plural, unless otherwise indicated herein or clearly contradicted by context.

The terms "comprising," "having," "including," and "containing" are to be construed as open-ended terms (i.e., meaning "including, but not limited to,") unless otherwise noted.

When any number or range is described herein, unless clearly stated otherwise, that number or range is approximate. Recitation of ranges of values herein are merely intended to serve as a shorthand method of referring individually to each separate value falling within the range, unless otherwise indicated herein, and each separate value and each separate subrange defined by such separate values is incorporated into the specification as if it were individually recited herein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any phrase (i.e., one or more words) appearing in a claim is followed by a drawing element number, that drawing element number is exemplary and non-limiting on claim scope.

No claim of this document is intended to invoke paragraph six of 35 USC 112 unless the precise phrase "means for" is followed by a gerund.

Any information in any material (e.g., a United States patent, United States patent application, book, article, etc.) that has been incorporated by reference herein, is incorporated by reference herein in its entirety to its fullest enabling extent permitted by law yet only to the extent that no conflict exists between such information and the other statements and drawings set forth herein. In the event of such conflict, including a conflict that would render invalid any claim herein or seeking priority hereto, then any such conflicting information in such material is specifically not incorporated by reference herein.

Within this document, and during prosecution of any patent application related hereto, any reference to any claimed subject matter is intended to reference the precise language of the then-pending claimed subject matter at that particular point in time only.

Accordingly, every portion (e.g., title, field, background, summary, description, abstract, drawing figure, etc.) of this document, other than the claims themselves and any provided definitions of the phrases used therein, is to be regarded as illustrative in nature, and not as restrictive. The scope of subject matter protected by any claim of any patent that issues based on this document is defined and limited only by the precise language of that claim (and all legal equivalents thereof) and any provided definition of any phrase used in that claim, as informed by the context of this document.

What is claimed is:

1. A gun comprising:

a tubular valve, the tubular valve moveable between a closed position and an open firing position, the open firing position adapted to cause a motive gas to expel a projectile from the gun, the tubular valve defining a tube having a end surface that extends substantially perpendicular to a longitudinal axis of the tube, an interior cavity portion, and an annular motive gas sealing face that forms at least a portion of the end surface of the tube; and the gun adapted to prevent, when said tubular valve is in the open firing position, the motive gas from flowing through the tubular valve.

2. The gun of claim 1, wherein:

the gun is adapted to, in the closed position and within approximately 2 milliseconds, substantially halt flow of the motive gas, the motive gas having a static pressure of approximately 3500 psi or more.

3. The gun of claim 1, wherein:

the gun is adapted to, in the open firing position and within approximately 10 milliseconds, pneumatically deliver up to approximately 2,500 foot pounds of energy to the projectile.

4. The gun of claim 1, further comprising:

a movable double acting piston connected to the tubular valve and adapted to move between an open piston position and a closed piston position as directed by a control gas provided by a solenoid controlled by a controller.

5. The gun of claim 1, further comprising:

a solenoid valve adapted to control a flow of a control gas provided to a piston that is adapted to open and close the tubular valve.

6. The gun of claim 1, further comprising:

a first solenoid valve adapted to control a flow of a control gas provided to a piston to open the tubular valve; and a second solenoid valve adapted to control a flow of a control gas provided to a piston to close the tubular valve;

the first solenoid valve timed independently from the second solenoid valve.

7. The gun of claim 1, further comprising:

a controller adapted to transmit a request for a timed burst of the motive gas, the request based on at least an available pressure of the motive gas and a weight of the projectile.

8. The gun of claim 1, further comprising:

a controller adapted to transmit a plurality of requests for a timed burst of the motive gas, each burst adapted to fire each of a plurality of projectiles at a substantially constant muzzle velocity throughout a range of reservoir gas pressures of from approximately 300 psi to approximately 3,500 psi, and throughout a range of projectile weights of from approximately 10 grains to approximately 1200 grains.

9. The gun of claim 1, further comprising:

a controller adapted to transmit a plurality of requests for a timed burst of the motive gas, each burst of gas adapted to fire one of a plurality of projectiles, all of the plurality of projectiles, upon exiting a muzzle of the gun, having a user-selected and substantially constant kinetic energy or a user-selected and substantially constant velocity, each burst corresponding to a different reservoir gas pressure.

10. The gun of claim 1, further comprising:

an energy indicator adapted to indicate a non-zero kinetic energy of the projectile.

11. The gun of claim 1, further comprising:

a velocity selector adapted to allow a user of the gun to input a user-selected non-zero velocity for the projectile.

12. The gun of claim 1, further comprising:

a kinetic energy selector adapted to allow a user of the gun to input a user-selected non-zero kinetic energy for the projectile.

13. The gun of claim 1, further comprising:

a user interface adapted to indicate at least one of a number of remaining firings, a pressure of the motive gas, and a position of a safety.

14. The gun of claim 1, further comprising:

a motive gas reservoir adapted to supply the motive gas.

15. The gun of claim 1, further comprising:

a regulator fluidly connected to a motive gas reservoir and adapted to control a pressure of the motive gas.

16. The gun of claim 1, further comprising:

a fixed core adapted to substantially fill the interior cavity portion when said tubular valve is in the open firing position.

17. The gun of claim 1, wherein:

the gun is adapted to prevent, when said tubular valve is in the open firing position, the motive gas from flowing through a fixed core.

18. The gun of claim 1, wherein:

the gun is adapted to prevent, when said tubular valve is in the open firing position, the motive gas from flowing through the interior cavity portion.

19. The gun of claim 1, further comprising:

a double-acting piston connected to the tubular valve and adapted to control a position of the tubular valve within the gun responsive to the motive gas.

20. A gun comprising:

a controller adapted to transmit a plurality of requests for a calculated burst of gas, each burst of gas adapted to fire one of a plurality of projectiles, all of the plurality of projectiles, upon exiting a muzzle of the gun, having a user-selected and substantially constant kinetic energy or a user-selected and substantially constant velocity, each burst corresponding to a different reservoir gas pressure, a duration of each burst calculated based on a user-selectable projectile weight.

21. A method comprising:

transmitting, from a predetermined gun controller, a request for a burst of gas adapted to fire a projectile, the request identifying a calculated duration of the burst, the calculated duration based on at least an available motive gas pressure, a user-selectable weight of the projectile, and a predetermined non-zero kinetic energy for the projectile or a predetermined non-zero velocity for the projectile.

* * * * *